US007929890B2

(12) United States Patent
Hazeyama

(10) Patent No.: US 7,929,890 B2
(45) Date of Patent: Apr. 19, 2011

(54) IMAGE FORMATION DEVICE AND DEVELOPER SUPPLY DEVICE

(75) Inventor: Tomoaki Hazeyama, Mie (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 33 days.

(21) Appl. No.: 12/407,220

(22) Filed: Mar. 19, 2009

(65) Prior Publication Data

US 2009/0238611 A1 Sep. 24, 2009

(30) Foreign Application Priority Data

Mar. 21, 2008 (JP) ..... 2008-073365
Mar. 21, 2008 (JP) ..... 2008-073369

(51) Int. Cl.
*G03G 15/08* (2006.01)

(52) U.S. Cl. ..... 399/281; 399/282; 399/284; 399/285

(58) Field of Classification Search ..... 399/265, 399/279, 281–286, 289–291
See application file for complete search history.

(56) References Cited

U.S. PATENT DOCUMENTS

| | | | | |
|---|---|---|---|---|
| 4,527,884 | A | 7/1985 | Nusser | |
| 4,598,991 | A | 7/1986 | Hosoya et al. | |
| 6,934,496 | B2 * | 8/2005 | Sakuma et al. | 399/265 |
| 2007/0242985 | A1 | 10/2007 | Aoki et al. | |

FOREIGN PATENT DOCUMENTS

| | | | |
|---|---|---|---|
| JP | 58-066969 | A | 4/1983 |
| JP | 59-181371 | | 10/1984 |
| JP | 06-027806 | A | 2/1994 |
| JP | 2003-015417 | | 1/2003 |
| JP | 2005-275127 | | 10/2005 |
| JP | 2006-047654 | A | 2/2006 |
| JP | 2007-310355 | | 11/2007 |
| JP | 2008-040043 | | 2/2008 |
| JP | 2008-052034 | | 3/2008 |

OTHER PUBLICATIONS

Notice of Reasons of Rejection for Japanese Patent Application No. 2008-073365 dated Feb. 9, 2010.
Notice of Reasons of Rejection for Japanese Patent Application No. 2008-073369 dated Feb. 9, 2010.

* cited by examiner

*Primary Examiner* — Hoang Ngo
(74) *Attorney, Agent, or Firm* — Banner & Witcoff, Ltd.

(57) ABSTRACT

There is provided an image formation device, comprising: a holding body configured to hold thereon developer and to have a center axis extending in a main scanning direction; and a developer supply unit configured to supply the developer to the holding body through a traveling electric field, the developer supply unit having an opening through which a part of the holding body is accommodated in the developer supply unit. In this configuration, the developer supply unit comprises a sliding member configured to slide on at least a part of a surface of the holding body moving toward an outside of the developer supply unit through the opening.

22 Claims, 16 Drawing Sheets

IMAGE FORMATION DEVICE AND DEVELOPER SUPPLY DEVICE

CROSS-REFERENCE TO RELATED APPLICATION

This application claims priority under 35 U.S.C. §119 from Japanese Patent Applications No. 2008-073365, filed on Mar. 21, 2008, and No. 2008-073369, filed on Mar. 21, 2008. The entire subject matter of the applications is incorporated herein by reference.

BACKGROUND

1. Technical Field

Aspects of the present invention relate to an image formation device and a developer supply device.

2. Related Art

Developer supply devices capable of supplying developer (i.e., dry type developer, such as dry type toner) through use of a traveling electric field have been widely used. Examples of such developer supply devices used for image formation devices are disclosed in Japanese Patent Provisional Publications No. SHO 59-181371A, No. 2003-15417A, No. 2005-275127A, No. 2007-310355A, No. 2008-40043A, and No. 2008-52034A.

SUMMARY

It is noted that a configuration around a development position where developer is supplied from a developer supply unit to an electrostatic latent image holding body has a considerable effect on the quality of a formed image.

Aspects of the present invention are advantageous in that at least one of an image formation device and a developer supply device having a structure to contribute to forming an excellent image around the development position is provided.

According to an aspect of the invention, there is provided an image formation device, comprising: a holding body configured to hold thereon developer and to have a center axis extending in a main scanning direction; and a developer supply unit configured to supply the developer to the holding body through a traveling electric field, the developer supply unit having an opening through which a part of the holding body is accommodated in the developer supply unit. In this configuration, the developer supply unit comprising a sliding member configured to slide on at least a part of a surface of the holding body moving toward an outside of the developer supply unit through the opening.

Since the sliding member slides on the part of the surface of the holding body moving toward an outside of the developer supply unit through the opening, a high quality image can be formed.

In at least one aspect, the holding body comprises an electrostatic latent image holding body having an semicylindrical part having the center axis extending in parallel with the main scanning direction, the electrostatic latent image holding body having a latent image formation surface on which an electrostatic latent image is formed as potential distribution. In this case, the electrostatic latent image holding body is configured such that the latent image formation surface moves in a direction perpendicular to the main scanning direction. The developer supply unit has a plurality of carrying electrodes arranged along a direction intersecting with the main scanning direction, and is configured to move the developer in the direction intersecting with the main scanning direction through the traveling electric field to supply the developer to the latent image formation surface of the electrostatic latent image holding body. The developer supply unit is configured to accommodate therein the semicylindrical part of the electrostatic latent image holding body through the opening. Further, the sliding member is configured to slide on a part of the latent image formation surface moving toward the outside of the developer supply unit.

In at least one aspect, the image formation device further comprises an electrostatic latent image holding body having a latent image formation surface on which an electrostatic latent image is formed as potential distribution. In this case, the holding body comprises a developer holding body having a cylindrical shape and having a cylindrical developer holding surface on which the developer is held. The developer supply unit comprises the developer holding body. The developer supply unit has a plurality of carrying electrodes arranged along a direction intersecting with the main scanning direction, and is configured to move the developer in the direction intersecting with the main scanning direction through the traveling electric field to supply the developer to the cylindrical developer holding surface so that the developer is supplied to the latent image formation surface of the electrostatic latent image holding body. The developer supply unit is configured to accommodate therein a part of the developer holding body and to expose the other part of the developer holding body to the outside of the developer supply unit. The sliding member is configured to slide on a part of the cylindrical developer holding surface moving toward the outside of the developer supply unit.

According to another aspect of the invention, there is provided a developer supply device, comprising: a plurality of electrodes arranged in a direction intersecting with a main scanning direction to supply developer through a traveling electric field; an opening through which a part of a holding body to hold the developer is accommodated in the developer supply unit, and a sliding member configured to slide on at least a part of a surface of the holding body moving toward an outside of the developer supply device through the opening.

Since the sliding member slides on the part of the surface of the holding body moving toward an outside of the developer supply unit through the opening, a high quality image can be formed.

In at least one aspect, the holding body comprises an electrostatic latent image holding body having an semicylindrical part having a center axis extending in parallel with the main scanning direction, the electrostatic latent image holding body having a latent image formation surface on which an electrostatic latent image is formed as potential distribution. In this case, the electrostatic latent image holding body is configured such that the latent image formation surface moves in a direction perpendicular to the main scanning direction. The plurality of carrying electrodes are arranged to move the developer in the direction intersecting with the main scanning direction through the traveling electric field to supply the developer to the latent image formation surface of the electrostatic latent image holding body. The semicylindrical part of the electrostatic latent image holding body is accommodated in the developer supply device through the opening. Further, the sliding member is configured to slide on a part of the latent image formation surface moving toward the outside of the developer supply device.

In at least one aspect, the developer supply device further comprises, as the holding body, a developer holding body having a cylindrical shape and having a cylindrical developer holding surface on which the developer is held. In this case, the plurality of carrying electrodes are arranged to move the developer in the direction intersecting with the main scanning direction through the traveling electric field to supply the developer to the cylindrical developer holding surface of the developer holding body. A part of the developer holding body is accommodated in the developer supply device and the other part of the developer holding body is exposed to the outside of the developer supply device so that the other part of the developer holding body faces an electrostatic latent image holding body provided outside of the developer supply device. Further, the sliding member is configured to slide on a part of the cylindrical developer holding surface moving toward the outside of the developer supply device.

It is noted that various connections are set forth between elements in the following description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

BRIEF DESCRIPTION OF THE ACCOMPANYING DRAWINGS

DETAILED DESCRIPTION

Hereafter, embodiments according to the invention will be described with reference to the accompanying drawings.

FIRST EMBODIMENT

Figure 1:
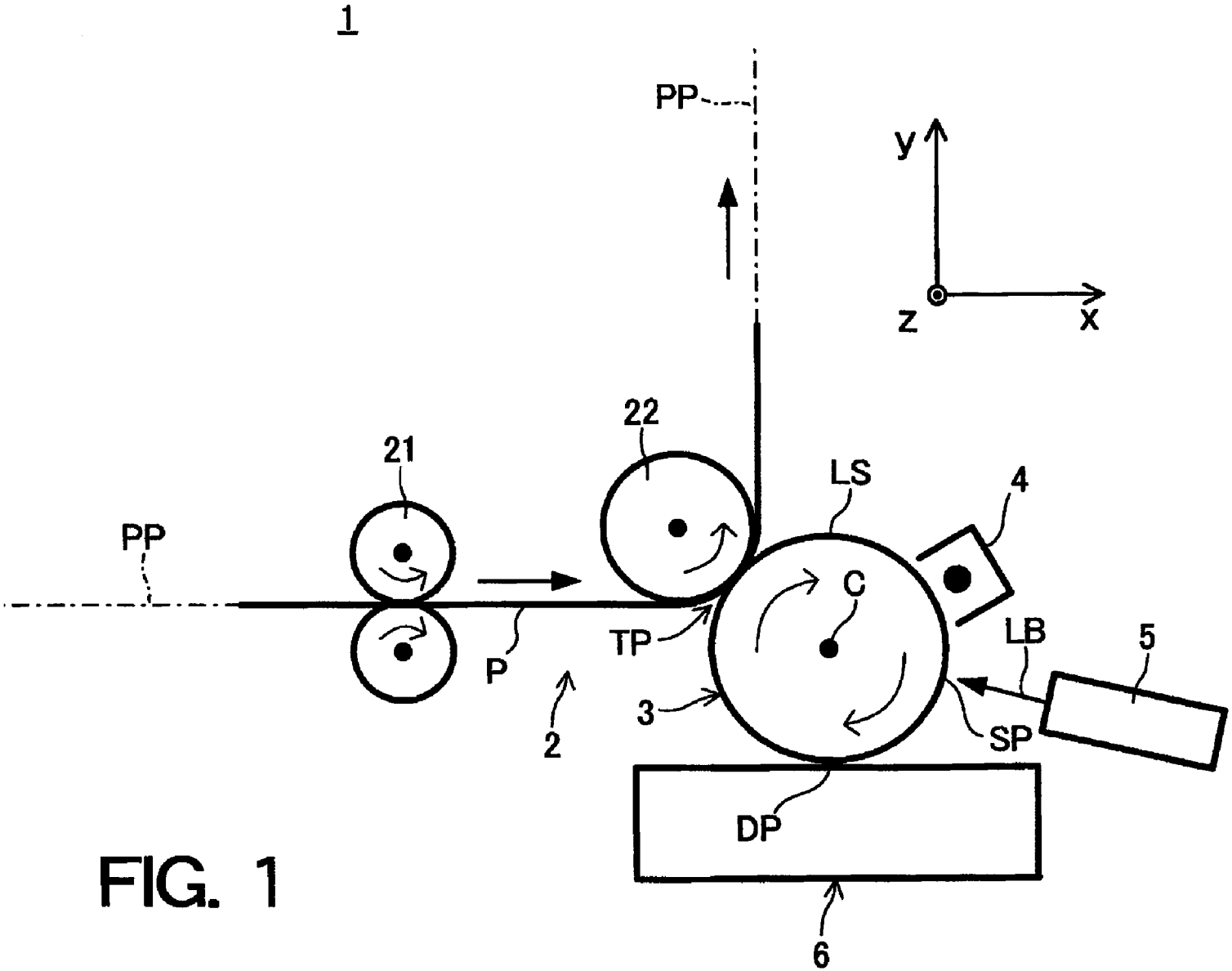
FIG. 1 is a side cross section illustrating a general internal configuration of a laser printer according to a first embodiment.

FIG. 1 is a side cross section illustrating a general internal configuration of a laser printer 1 according to a first embodiment. As shown in FIG. 1, the laser printer 1 includes a paper carrying unit 2, a photosensitive drum 3, a charger 4, a scanning unit 5 and a toner supply unit 6.

In a paper supply tray (not shown) provided in the laser printer 1, a stack of sheets of paper P is placed. The paper carrying unit 2 is configured to carry the sheet of paper P along a predetermined paper transport path PP. More specifically, the paper carrying unit 2 includes a pair of registration rollers 21 and a transfer roller 22.

The registration rollers 21 are configured to supply the sheet of paper P to the position between the photosensitive drum 3 and the transfer roller 22 at predetermined timing. The transfer roller 22 is positioned to face a latent image formation surface LS at a transfer position TP while sandwiching the sheet of paper P between the transfer roller 22 and the latent image formation surface LS. The latent image formation surface LS is an outer circumferential surface of the photosensitive drum 3. The transfer roller 22 is rotated in a rotational direction indicated by an arrow shown in FIG. 1 (i.e., in a counterclockwise direction in FIG. 1).

The transfer roller 22 is connected to a bias power circuit (not shown). From the bias power circuit, a predetermined transfer bias voltage for transferring the toner adhered to the latent image formation surface LS to the sheet of paper P between the photosensitive drum 3 and the transfer roller 22 is applied to the transfer roller 22.

The photosensitive drum 3 serving as an electrostatic latent image holding body has a cylindrical drum shape having a center axis extending in parallel with a main scanning direction (i.e., a z-axis direction in FIG. 1) and is configured to be rotatable in a rotational direction indicated by an arrow shown in FIG. 1 (i.e., a clockwise direction in FIG. 1).

On the outer circumferential surface of the photosensitive drum 3, the latent image formation LS is formed. The latent image formation surface LS is a cylindrical surface provided to be parallel with the center axis (i.e., parallel with the main scanning direction), and is configured such that an electrostatic latent image is formed thereon as a potential distribution. The photosensitive drum 3 is provided such that the latent image formation surface LS moves along an auxiliary scanning direction which is perpendicular to the main scanning direction.

The term "auxiliary scanning direction" means a direction perpendicular to the main scanning direction. Typically, the auxiliary direction is defined as a direction intersecting with a vertical direction. That is, the auxiliary scanning direction is defined along a back-and-forth direction of the laser printer 1. In other words, the auxiliary scanning direction is a direction perpendicular to the paper width direction and the height direction (i.e., an x-axis direction in FIG. 1).

The charger 4 is provided to face the latent image formation surface LS. The charger 4 is a corotron type charger or a scorotron charger, and is configured to charge uniformly the latent image formation surface LS.

The scanning unit 5 is configured to emit a laser beam LB modulated based on image data. That is, the scanning unit 5 emits the laser beam LB which is on/off modulated in accordance with presence/absence of pixel data and which has a predetermined wavelength band. Further, the scanning unit 5 is configured to converge the laser beam LB at a scan position SP on the latent image formation surface LS. The scan position SP is located on the downstream side in the rotational direction of the photosensitive drum 3 with respect to the charger 4.

Further, the scanning unit 5 is configured to scan the laser beam LB, at the converged position, on the latent image formation surface LS in the main scanning direction at a constant speed, so that an electrostatic latent image is formed on the latent image formation surface LS.

The toner supply unit 6 (serving as a developer supply unit) is positioned to face the photosensitive drum 3 at a development position DP.

Figure 2:
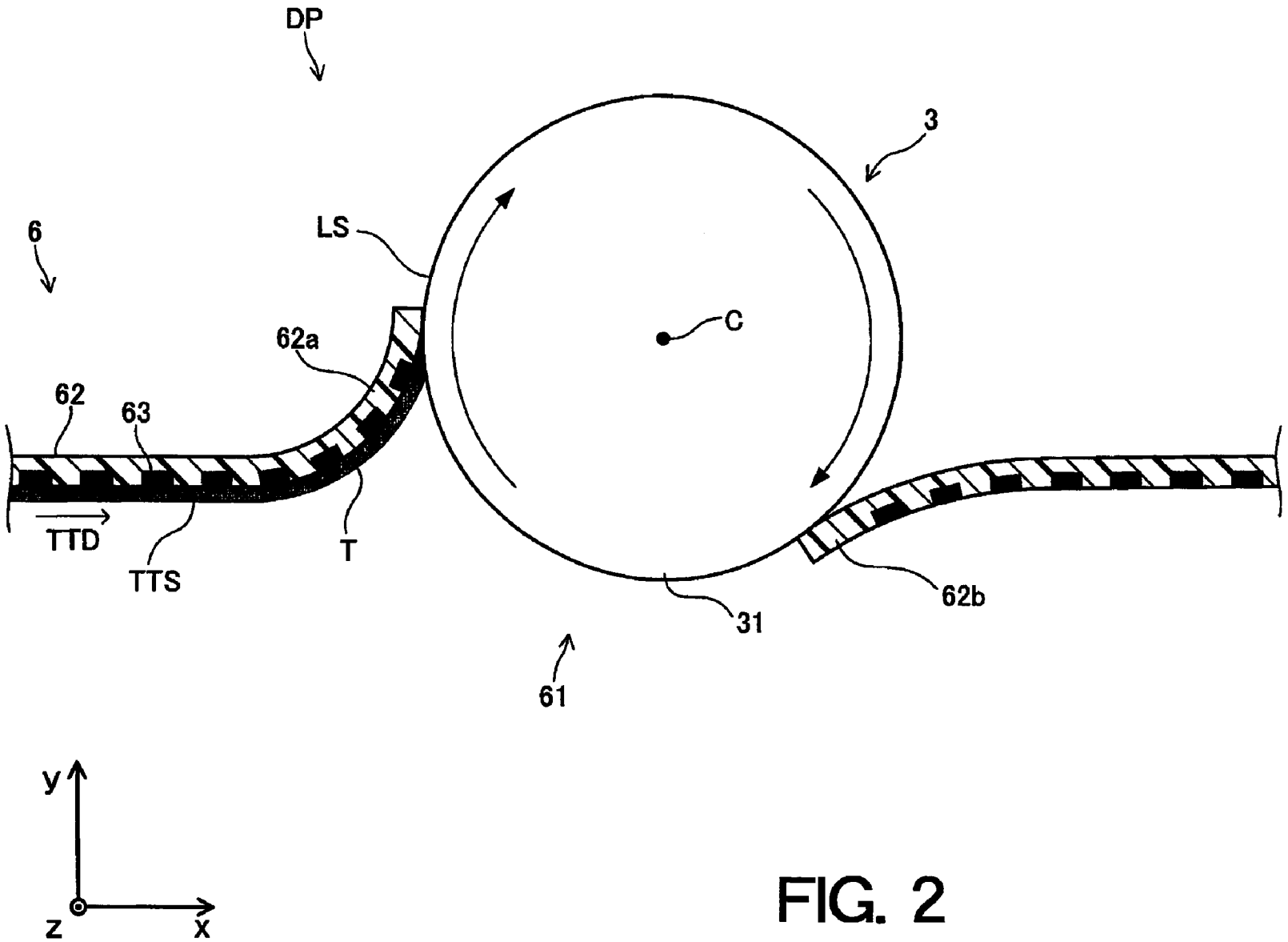
FIG. 2 is an enlarged side cross section illustrating a principal portion of a toner supply unit provided in the laser printer.

FIG. 2 is an enlarged side cross section illustrating a principal portion of the toner supply unit 6. Hereafter, the structure around the development position DP is explained in detail with reference to FIGS. 1 and 2. It should be noted that FIG. 1 is illustrated to easily understand the general configuration of the internal units of the laser printer 1. Actually, a lower part of the photosensitive drum 3 is accommodated in the toner supply unit 6 as described in detail below (see FIG. 2).

The toner supply unit 6 is configured to supply the toner T (dry type developer) to the latent image formation surface LS while carrying the positively charged toner T in a toner transport direction TTD (i.e., a direction perpendicular to the center axis C). As shown in FIG. 2, the toner supply unit 6 is configured to accommodate therein a semicylindrical part 31 of the photosensitive drum 3 (i.e., a lower half portion of the photosensitive drum 3) and to locate the other part of the photosensitive drum 3 outside the toner supply unit 6.

More specifically, the toner supply unit 6 has an opening 61 through which the semicylindrical part 31 penetrates. The toner supply unit 6 has a toner carrying substrate 62 serving as a developer carrying substrate. The toner carrying substrate 62 is a thin plate-like member including an upstream edge part 62*a* and a downstream edge part 62*b* constituting a sliding member.

Each of the upstream edge part 62*a* and the downstream edge part 62*b* is configured such that an edge at the opening 61 is formed as a free end. Each of the upstream edge part 62*a* and the downstream edge part 62*b* protrudes toward the opening 61 and is elastically deformable in the vertical direction. That is, each of the upstream edge part 62*a* and the downstream edge part 62*b* is formed to be a beam fixed only at one end thereof.

The upstream edge part 62*a* is configured to elastically press and slide on the portion of the latent image formation surface LS moving to the outside from the opening 61, on the upstream side in the toner transport direction TTD with respect to the opening 61. Further, the upstream edge part 62*a* is positioned such that a toner transport surface TTS which is an inner surface facing the inside of the toner supply unit 6 slides on the latent image formation surface LS. The upstream edge part 62*a* is configured to slide on the latent image formation surface LS along the entire length thereof in the main scanning direction.

The downstream edge part 62*b* is configured to elastically press and slide on the portion of the latent image formation surface LS moving to enter the inside from the opening 61, on the downstream side in the toner transport direction TTD with respect to the opening 61. Further, the downstream edge part 62*b* is positioned such that an outer surface thereof facing the outside slides on the latent image formation surface LS. The downstream edge part 62*b* is configured to slide on the latent image formation surface LS along the entire length thereof in the main scanning direction.

The toner carrying substrate 62 is provided with a plurality of carrying electrodes 63 on an insulative support layer. The plurality of carrying electrodes 63 are arranged in the auxiliary scanning direction which is parallel with the toner transport direction TTD so that the charged toner T is carried in the toner transport direction TTD through a traveling electric field.

Hereafter, operations of the laser printer 1 is explained.

The leading edge of the sheet of paper P stacked on the paper supply tray (not shown) is carried to the registration roller 21 along the paper transport path PP. The registration roller corrects skew of the sheet of paper P and adjusts the carrying timing. Then, the sheet of paper P is carried to the transfer position TP along the paper transport path PP.

While the sheet of paper P is carried toward the transfer position TP, a toner image is formed on the latent image formation surface LS as follows.

First, the latent image formation surface LS of the photosensitive drum 3 is charged uniformly by the charger 4. The latent image formation surface LS charged by the charger 4 moves to the scan position SP by rotation in the direction indicated by the arrow shown in FIG. 1. That is, the latent image formation surface LS moves, in the auxiliary scanning direction, to the scan position SP facing the scanning unit 5.

At the scan position SP, the laser beam LB on/off modulated in accordance with the image data scans on the latent image formation surface LS in the main scanning direction. In accordance with the modulation of the laser beam LB, parts of the positive charges on the latent image formation surface LS disappear. As a result, a pattern of positive charges is formed on the latent image formation surface LS as an electrostatic latent image.

The electrostatic latent image formed on the latent image formation surface LS moves to the development position DP facing the toner supply unit 6 by rotation of the photosensitive drum 3 in the direction indicated by the arrow shown in FIG. 1 (i.e., in the clockwise direction).

The voltage having a traveling waveform is applied to the plurality of electrodes 63 on the toner carrying substrate 62. As a result, the traveling electric field is produced on the toner transport surface TTS. Through the traveling electric field, the positively charged toner T is carried on the toner transport surface TTS in the toner transport direction TTD.

As described above, the positively charged toner T is carried on the toner transport surface TTS in the toner transport direction TTS. As a result, the toner T is supplied to the development position DP.

At the development position DP, the toner transport surface TTS elastically presses and slides on the latent image formation surface LS while sandwiching a thin layer of the toner T between the toner transport surface TTS and the latent image formation surface LS. That is, at the development position DP, the toner transport surface TTS and the latent image formation surface LS slides with respect to each other. At this time, the electrostatic latent image formed on the latent image formation surface LS is developed by the toner T. That is, to the parts on the latent image formation surface from which the positive charges disappear, the toner T is adhered. As a result, the toner image is held on the latent image formation surface LS.

The toner image thus held on the latent image formation surface LS is moved to the transfer position TP by rotation of the latent image formation surface LS in the direction indicated by the arrow shown in FIG. 1 (i.e., in the clockwise direction). At the transfer position TP, the toner image is transferred from the latent image formation surface LS to the sheet of paper P.

Hereafter, advantages achieved by the first embodiment are described. As described above, the toner transport surface TTS which is the inner surface of the upstream edge part 62*a* elastically presses and slides on the portion of the latent image formation surface LS moving to the outside from the opening 61 while sandwiching the thin toner layer between the toner transport surface TTS and the latent image formation surface LS. Therefore, the electrostatic latent image on the latent image formation surface LS is developed while being pressed elastically by the toner transport surface TTS sandwiching the thin toner layer between the toner transport surface TTS and the latent image formation surface LS.

Therefore, according to the embodiment, occurrence of "thinning" of an edge part of an image can be prevented suitably. More specifically, by pressing the toner image with the toner transport surface TTS, it becomes possible to flatten the toner image on the latent image formation surface LS, and thereby it becomes possible to prevent occurrence of the "thinning" of the edge pat of the image.

In the above described embodiment, the toner transport surface TTS of the upstream edge part 62*a* face-contacts the portion of the latent image formation surface LS moving to the outside from the opening 61 while sandwiching the thin toner layer between the toner transport surface TTS and the latent image formation surface LS. Therefore, the electrostatic latent image on the latent image formation surface LS is developed while face-contacting the toner transport surface TTS and sandwiching the thin toner layer between the toner transport surface TTS and the latent image formation surface LS. At this tome, a certain amount of toner T is pooled between the toner transport surface TTS of the upstream edge part 62*a* and the latent image formation surface LS.

Therefore, according to such a configuration, occurrence of "thinning" of an edge part of an image can be prevented more effectively. In addition, occurrence of fluctuations of density of an image in the auxiliary scanning direction can be prevented effectively.

In the above described first embodiment, the semicylindrical part 31 of the photosensitive drum 3 is accommodated in the toner supply unit 6 through the opening 61. The upstream edge part 62*a* which is an upstream side edge of the opening 61 in the toner transport direction TTD and the downstream edge part 62*b* which is an downstream side edge of the opening 61 in the toner transport direction TTD slide on the latent image formation surface LS.

According to such a configuration, the toner T can be prevented from leaking to the outside of the toner supply device 6 through the opening 61. Therefore, the inside of the laser printer 1 and the sheet of paper P can be effectively prevented from being tainted due to leaking of the toner T.

In the first embodiment, the inner surface of the upstream edge part 62*a* slides on the portion of the latent image formation surface LS moving to the outside from the opening 61 (i.e., the portion on which the toner has been held), and the outer surface of the downstream edge part 62*b* slides on the portion of the latent image formation surface LS entering the toner supply unit 6 through the opening 61 (i.e., the portion where the toner has not been held).

Therefore, if the laser printer 1 is configured such that the photosensitive drum 3 is detachable from the toner supply unit 6, the toner T is effectively prevented from leaking to the outside of the toner supply unit 6 when the photosensitive drum 3. For example, attachment and detachment of the photosensitive drum 3 and the toner supply unit 6 are achieved as follows.

For attachment, the photosensitive drum 3 is relatively moved from the upper right side to the left side (i.e., to the upstream side in the toner transport direction TTD) and to the lower side (i.e., to the inside of the toner supply unit 6) in FIG. 2. As a result, the semicylindrical part 31 enters the inside of the toner supply unit 6 through the opening 61 while pressing down and deforming the downstream edge part 62*b*. Then, the semicylindrical part 31 presses up and deforms the upstream edge part 62*a* while contacting the toner transport surface TTS which is the inner surface of the upstream edge part 62*a*. For detachment, a reverse operation is conducted.

Hereafter, variations of structures of the toner supply unit 6 are explained. In the following, only features of the variations are explained for the sake of simplicity. In the following drawings, to elements, which are substantially the same as those of the first embodiment, the same reference numbers are assigned.

(First Variation of First Embodiment)

Figure 3:
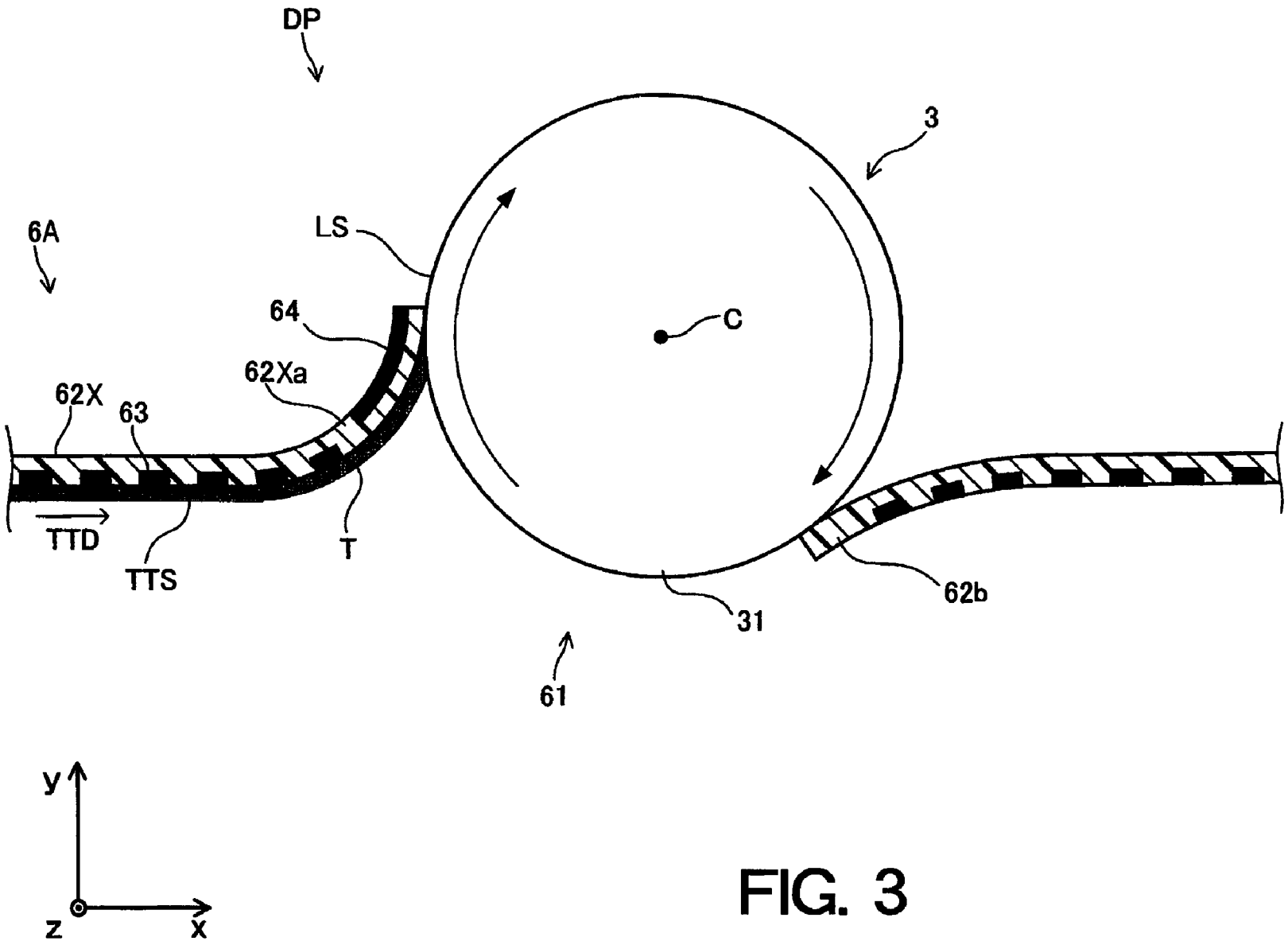
FIG. 3 is an enlarged cross section illustrating a structure of a toner supply unit of a first variation.

FIG. 3 is an enlarged cross section illustrating the structure of a toner supply unit 6A of a first variation. As shown in FIG. 3, the toner supply unit 6A is provided with a toner carrying substrate 62X having an upstream edge part 62Xa corresponding to the upstream edge part 62*a*. A tip end of the upstream edge part 62Xa is not provided with the carrying electrode 63. Instead, the tip end of the upstream edge part 62Xa is provided with a dummy electrode 64. The dummy electrode 64 is configured to be wider than the electrode 63 in the auxiliary scanning direction. In contrast to the carrying electrode 63, the dummy electrode 64 is supplied with a predetermined bias voltage. The predetermined bias voltage supplied to the dummy electrode 64 is set to a voltage not disarranging the electrostatic latent image on the latent image formation surface LS. For example, the predetermined bias voltage to the dummy electrode 64 is set a voltage corresponding to a surface potential of the not exposed portion where the positive charges remain on the latent image formation surface LS.

With this configuration, the part of the toner transport surface TTS sliding on the latent image formation surface LS is prevented from being charged up. Therefore, occurrence of disarrangement of an image due to adhesion of the toner T to such a part of the toner transport surface TTS can be prevented.

(Second Variation of First Embodiment)

Figure 4:
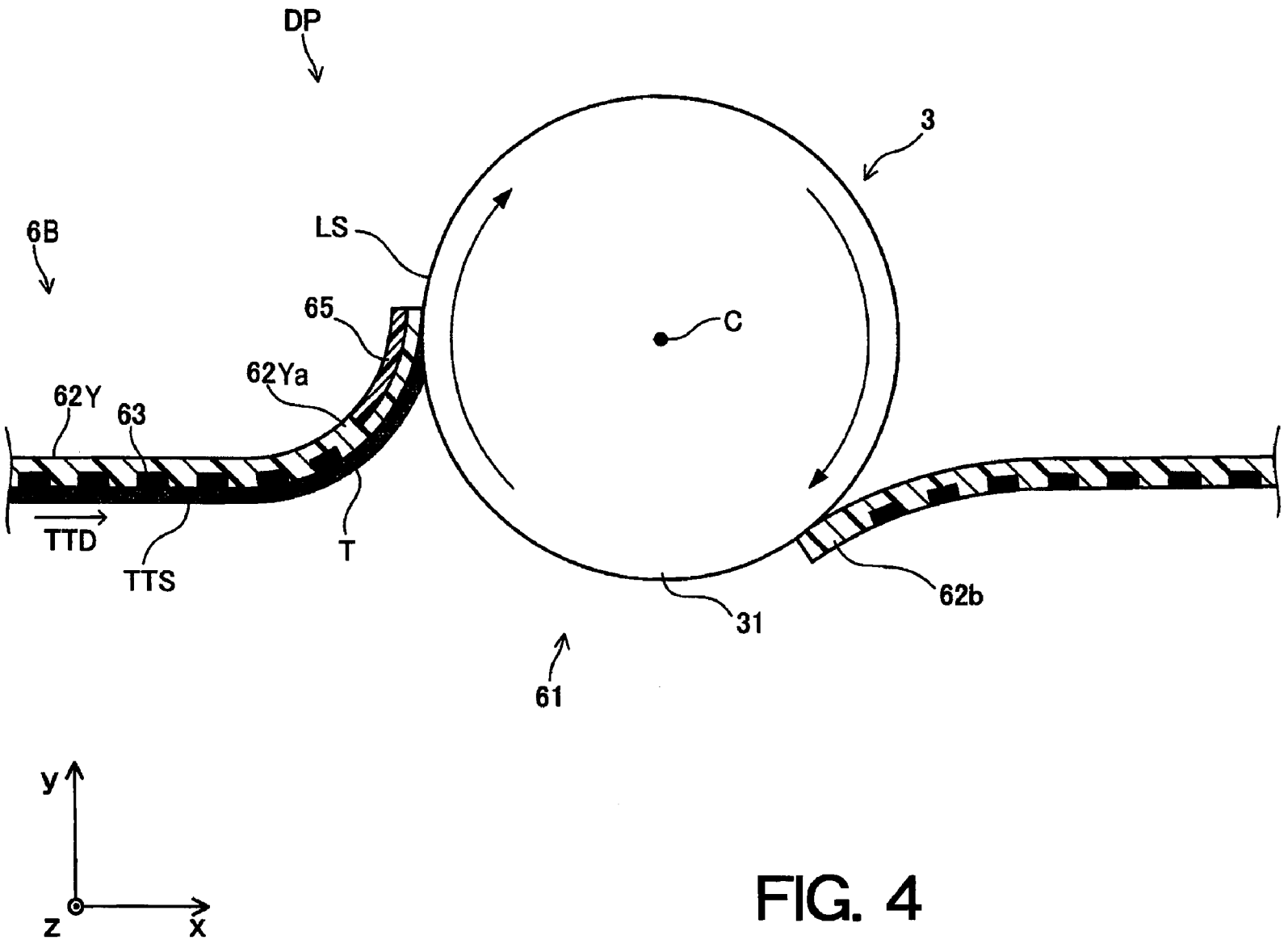
FIG. 4 is an enlarged cross section illustrating a structure of a toner supply unit of a second variation.

FIG. 4 is an enlarged cross section illustrating the structure of a toner supply unit 6B of a second variation. As shown in FIG. 4, the toner supply unit 6B is provided with a toner carrying substrate 62Y having an upstream edge part 62Ya corresponding to the upstream edge part 62*a*. A tip end of the upstream edge part 62Ya is not provided with the carrying electrode 63. Instead, the tip end of the upstream edge part 62Ya is provided with a conductor part 65. The conductor part 65 is integrally formed of material having conductivity (e.g., material having conductivity of volume resistivity ranging from $10^7$ to $10^{10}$ Ω·cm). As in the case of the dummy electrode 64 of the first variation, the conductor part 65 is supplied with a predetermined bias voltage.

With this configuration, the same advantages as those of the first variation can be achieved.

(Other Variations)

In the above described embodiment, the technical features are implemented on a monochrome laser printer. However, the technical features described in the embodiment can be implemented on various types of electrophotographic image formation devices, such as a color laser printer, or a monochrome or color facsimile device.

In the above described embodiment, the photosensitive drum 3 has a drum-like shape. However, the photosensitive drum may have a different shape.

Figure 5:
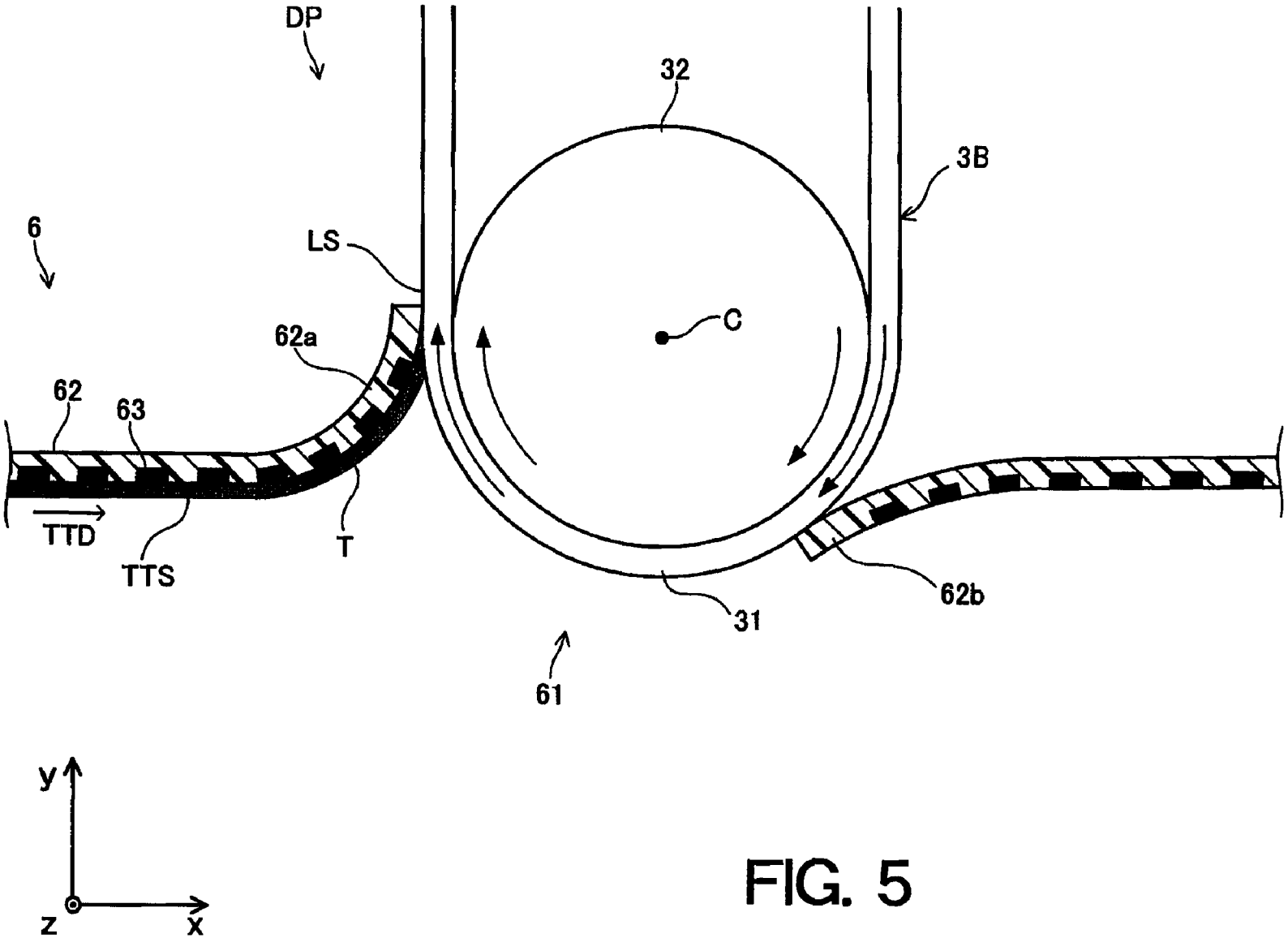
FIG. 5 illustrates a variation of a photosensitive drum serving as an electrostatic latent image holding body.
Figure 6:
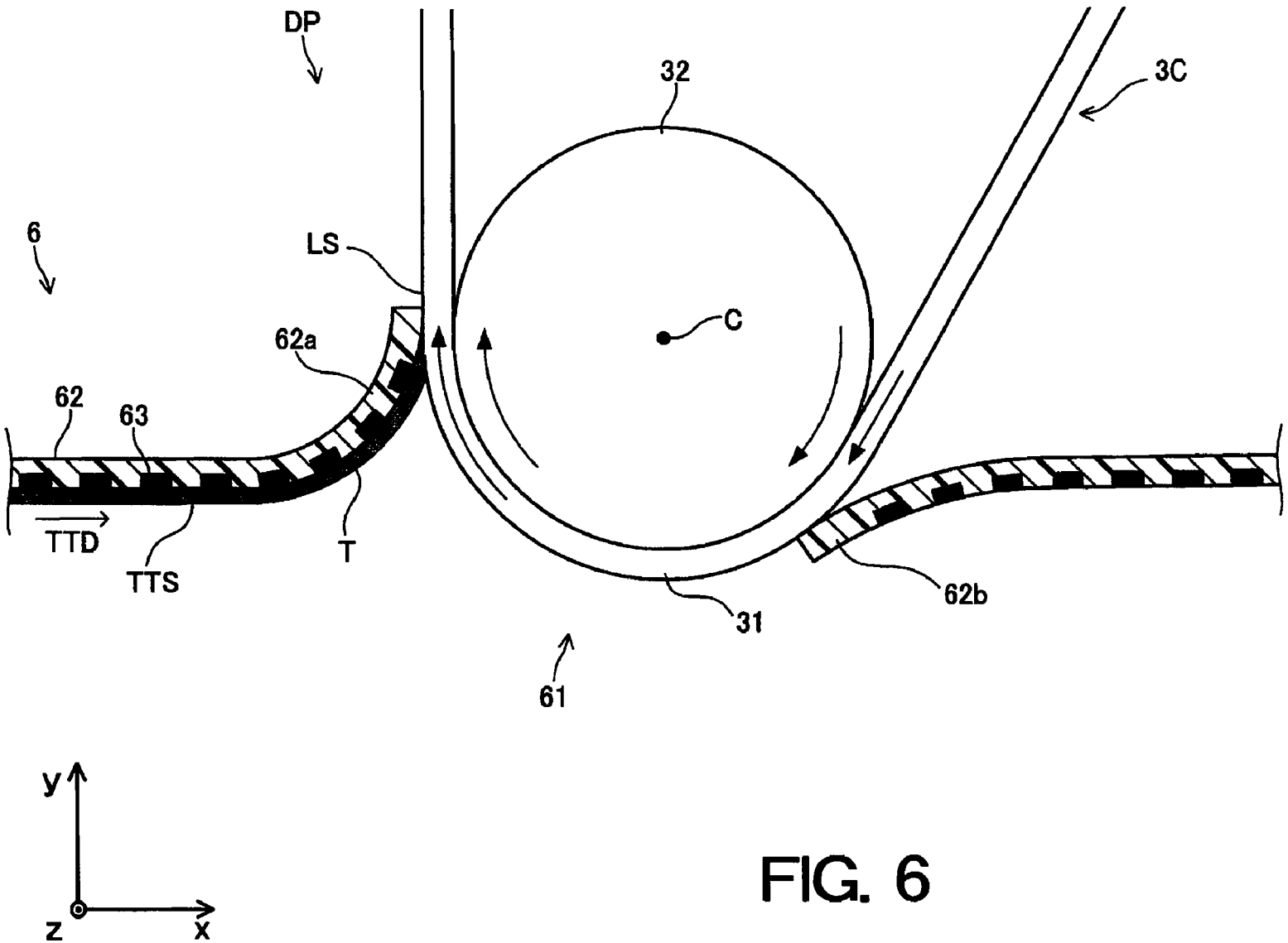
FIG. 6 illustrates another variation of a photosensitive drum serving as an electrostatic latent image holding body.

FIGS. 5 and 6 illustrate variations of the photosensitive drum 3 serving as an electrostatic latent image holding body. In FIGS. 5 and 6, to elements, which are substantially the same as those of the above described embodiment, the same reference numbers are assigned. As shown in FIGS. 5 and 6, the photosensitive drum (i.e., the electrostatic latent image holding bodies 3B and 3C) may have a form of an endless belt. In each of configurations shown in FIGS. 5 and 6, the electrostatic latent image holding body is supported by a belt support roller 32.

In the above described embodiment, the semicylindrical part 31 has a form of a complete semicylinder shape. However, it should be understood that the semicylindrical part 31 does not need to have a complete semicylinder shape. The semicylindrical part 31 may have a center angle smaller than 180 degrees, or may have a center angle larger than 180 degrees. In the examples shown in FIG. 6, the semicylindrical part 31 has a center angle of about 120 degrees.

A part of the semicylindrical part 31 may be accommodated in the toner supply unit 6. Alternatively, a part of the photosensitive drum 3 including the semicylindrical part 31 and another part of the photosensitive drum 31 may be accommodated in the toner supply unit 6.

In the above described embodiment, the upstream edge part 62*a* face-contacts the photosensitive drum 3. However, contact between the upstream edge par 62*a* and the photosensitive drum 3 is not limited to such face-contact. For example, the upstream edge part 62*a* may be provided such that an edge of the upstream edge part 62*a* contacts the photosensitive drum 3.

The structure of the part of the downstream edge part 62*b* sliding on the photosensitive surface LS moving to enter the inside of the toner supply unit through the opening 61 is not limited to that shown in the above described embodiment.

For example, the downstream edge part 62*b* may be configured not to have the carrying electrodes 63. Alternatively, the laser printer may be provided with a separate sliding member located separately from the toner carrying substrate 62. In this case, the separate sliding member is positioned to slide on the part of the photosensitive surface LS moving to enter the inside of the toner supply unit through the opening 61, in place of the downstream edge part 62*b*.

Figure 7:
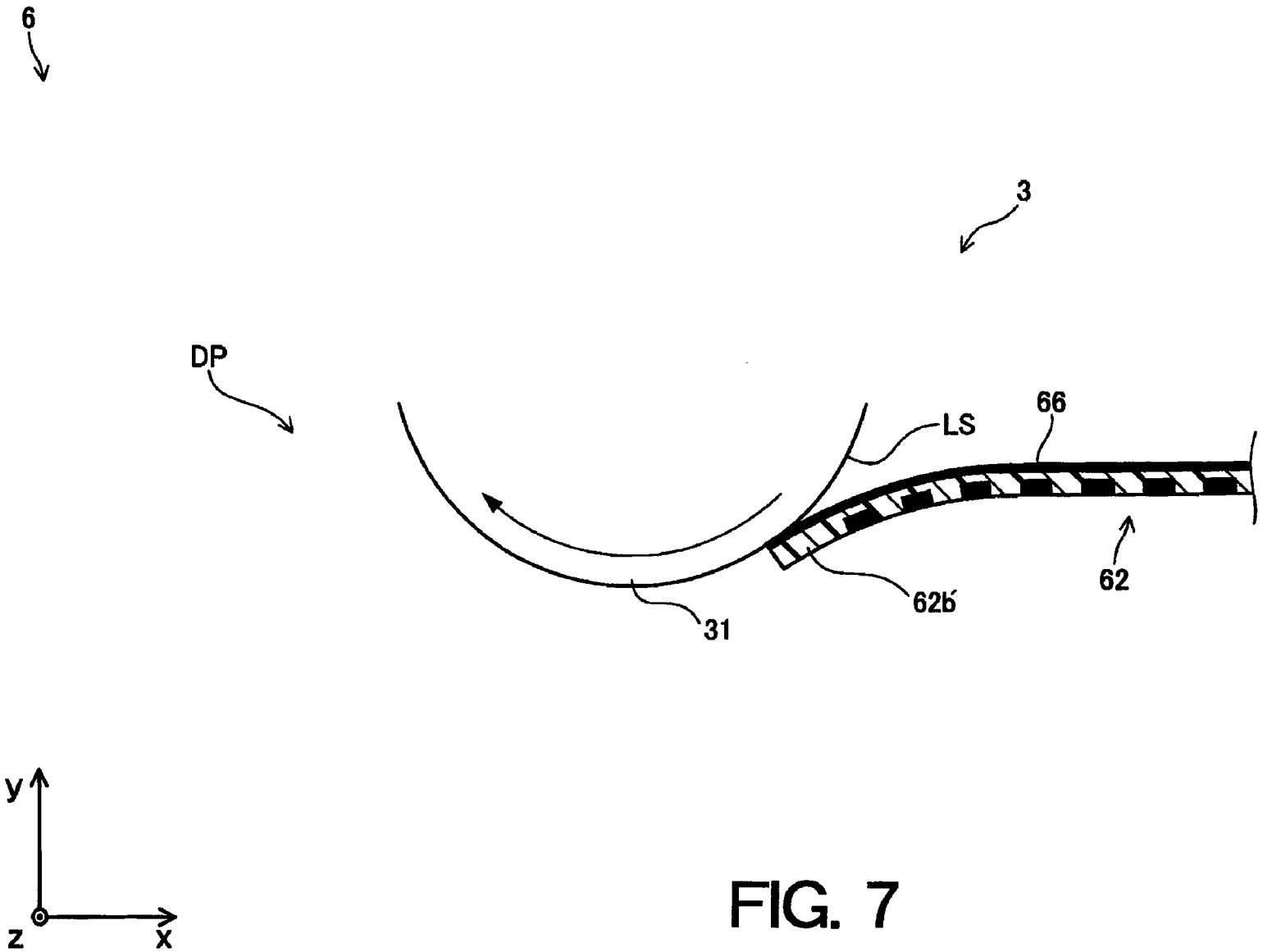
FIG. 7 illustrates a variation of a downstream edge part of a toner carrying substrate.

FIG. 7 illustrates a variation (a downstream edge part 62*b*') of the downstream edge part 62*b*. As shown in FIG. 7, the downstream edge part 62*b*' is configured such that a conductive layer 66 for preventing charging up may be formed on the surface of the toner carrying substrate 62 facing the latent image formation surface LS of the photosensitive drum 3.

The conductive layer 66 is formed of a coating layer having a conductivity (e.g., surface resistance of approximately $10^7$ to $10^{10}$ Ω/sq). The conductive layer 66 is supplied with the above described bias voltage to prevent the electrostatic latent image on the latent image formation surface LS from being disarranged by the downstream edge part 62*b*'.

Figure 8:
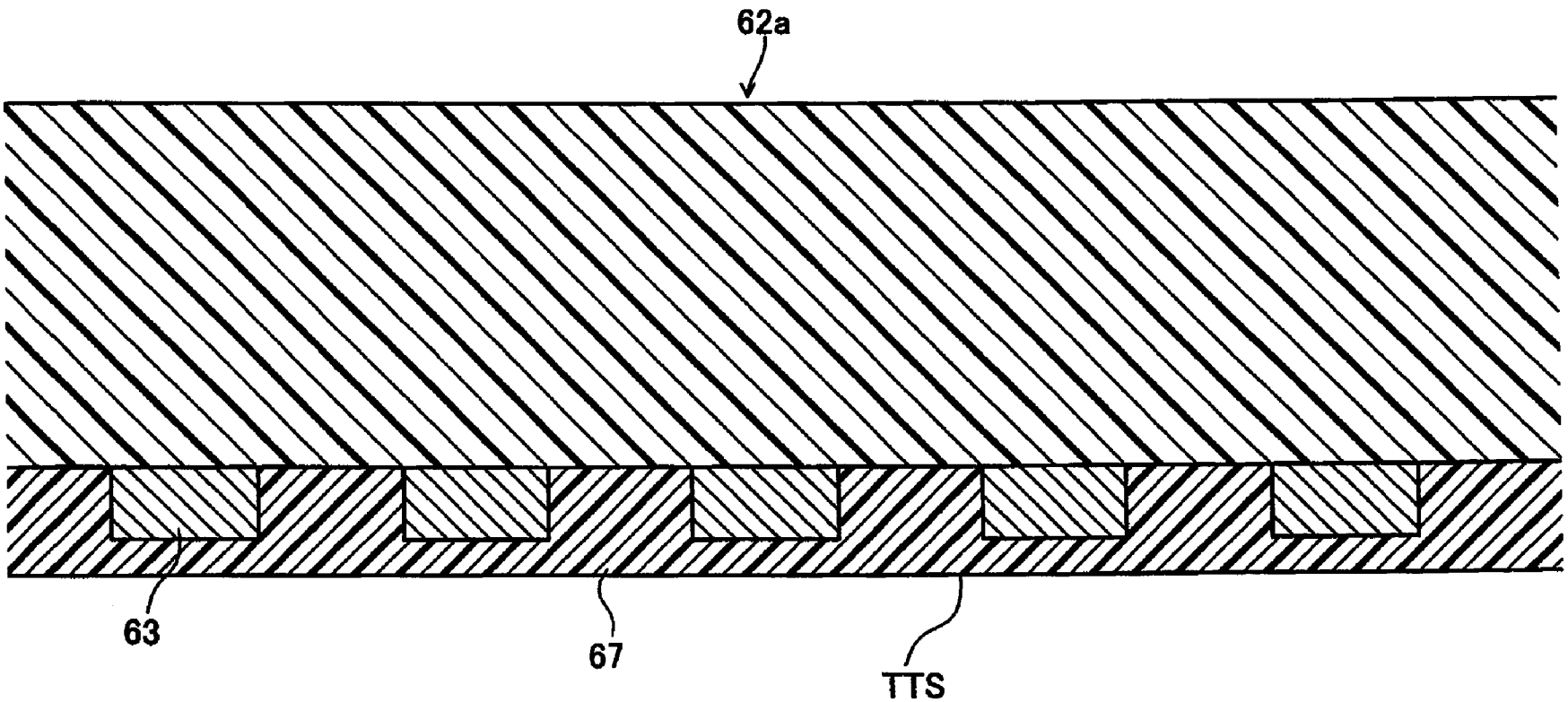
FIGS. 8 to 10 show variations of a structure of the toner carrying substrate.
Figure 9:
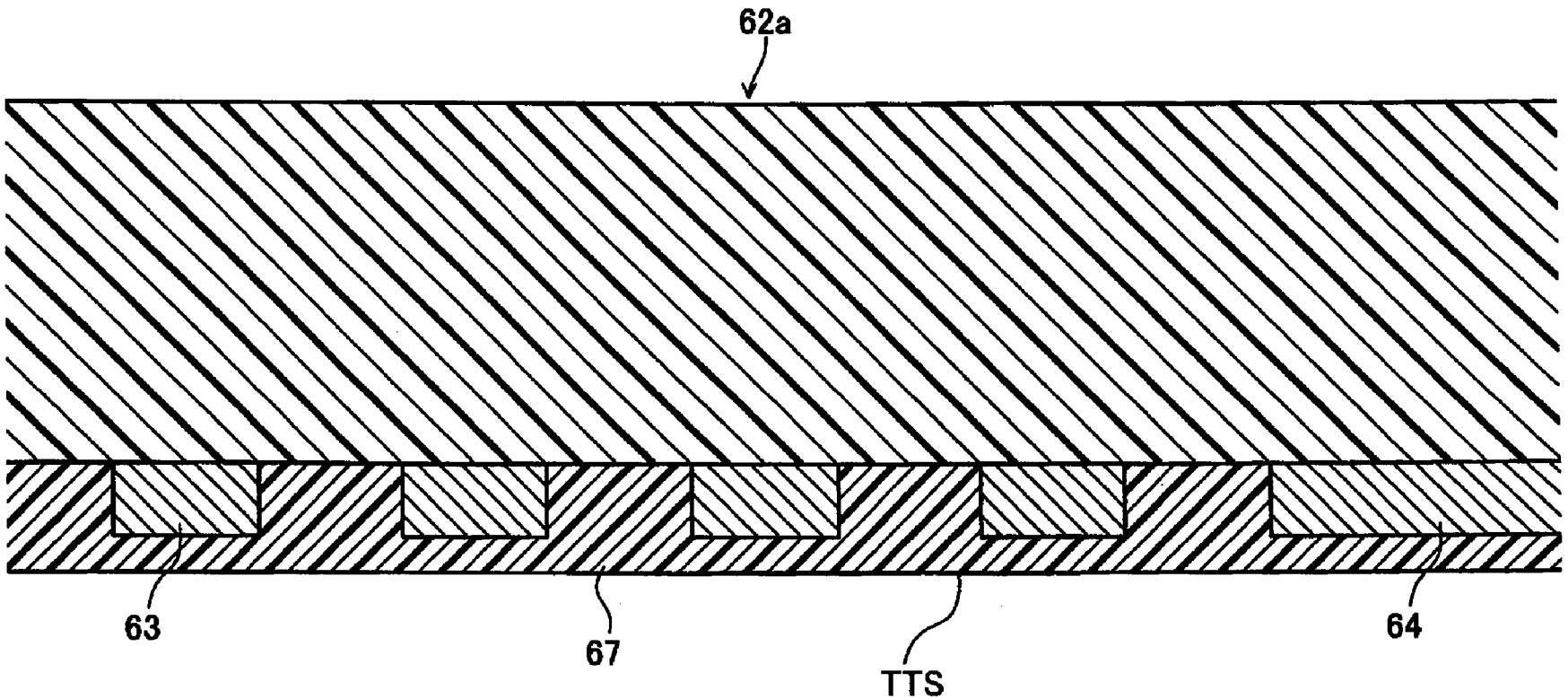
Figure 10:
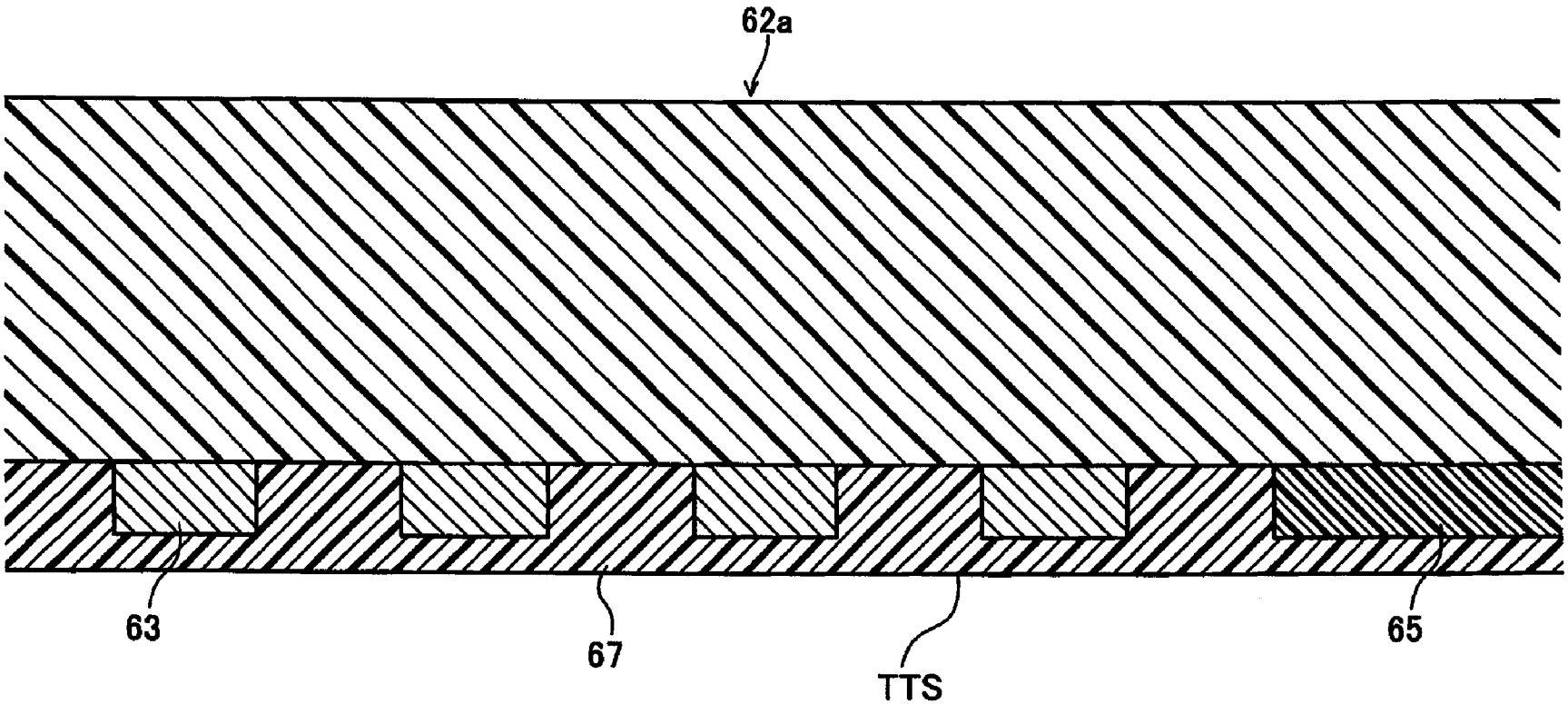

FIGS. 8 to 10 show variations of the structure of the toner carrying substrate 62.

As shown in FIG. 8, the toner carrying substrate 62 may be configured such that an insulative protective layer 67 is formed on the surface on which the electrodes 63 are provided to cover the carrying electrodes 63. For example, the protective layer 67 is formed of a coating layer made of synthetic resin. In this case, the surface of the protective layer 67 forms the toner transport surface TTS. That is, in this case, the toner carrying substrate 62 is formed by forming carrying electrodes 63 made of copper foil on an insulative support layer (e.g., a base film made of insulative synthetic resin) and then forming the protective layer 67 made of insulative synthetic resin.

As shown in FIGS. 9 and 10, the protective layer 67 may be formed on the toner carrying substrate 63X shown in FIG. 3 and on the toner carrying substrate 63Y shown in FIG. 4. In the example shown in FIG. 9, the protective layer 67 is formed on the based film to cover the dummy electrode 64 as well as the electrodes 63. In the example shown in FIG. 10, the protective layer 67 is formed on the base film to cover the conductor part 65 as well as the electrodes 63.

Material of the base film and the protective layer 67 is selected appropriately to prevent the electrostatic latent image from being disarranged due to charging up of the toner transport surface TTS during sliding of the upstream edge part on the latent image formation surface LS. For example, if a positively charged electrostatic latent image is formed, synthetic resin having a positive electrostatic property (e.g., polyamide (i.e., a so-called nylon)) is used as the base film, and the carrying electrodes 63 formed of copper foil are formed on the base film.

SECOND EMBODIMENT

Hereafter, a second embodiment is described. As described below, the second embodiment corresponds to a variation of a structure around the toner supply unit 6 and the photosensitive drum 3 shown in the first embodiment. Therefore, in the following, to elements, which are substantially the same as those of the first embodiment, the same reference numbers are assigned for the sake of simplicity.

Figure 11:
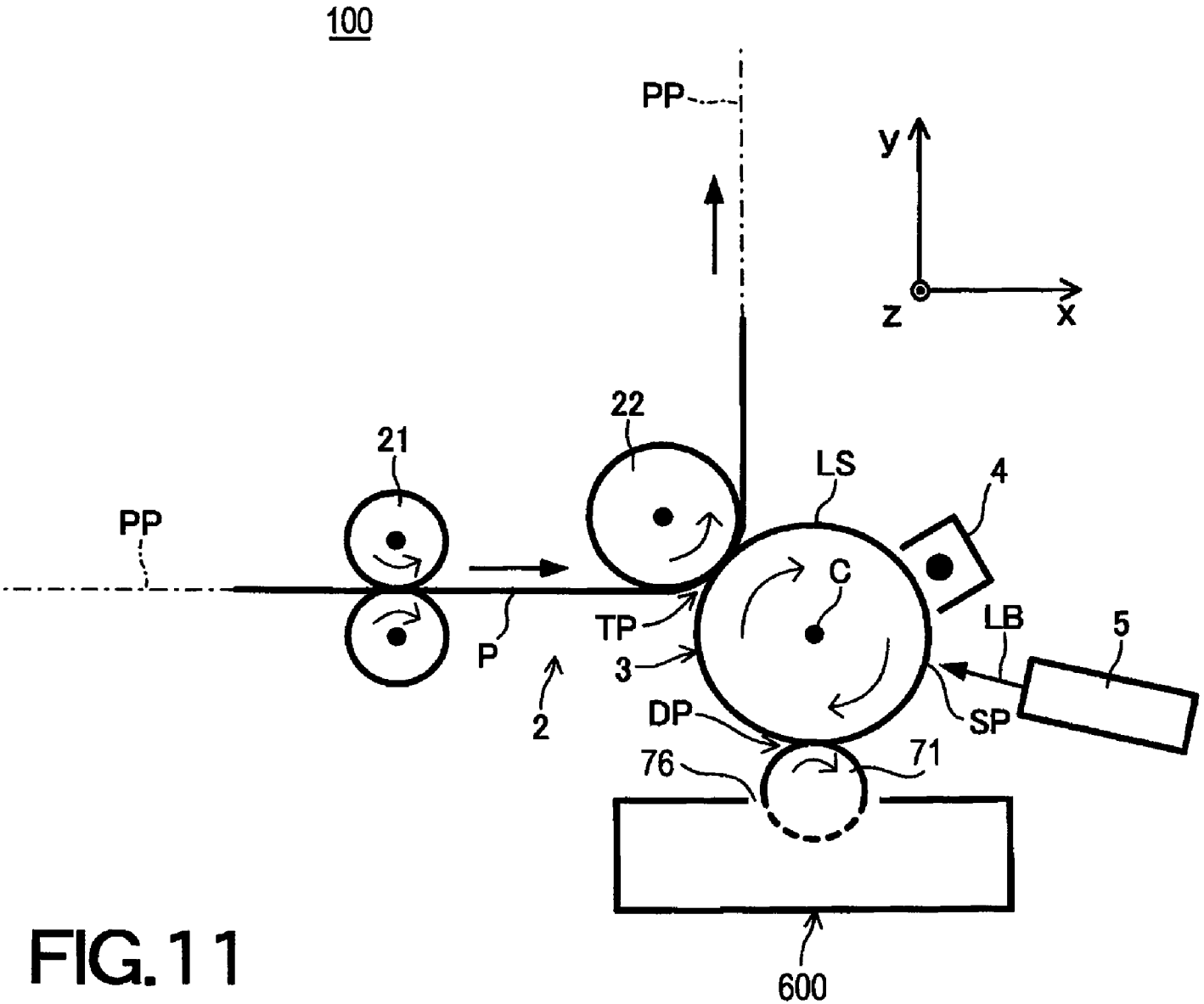
FIG. 11 is a side cross section illustrating a general internal configuration of a laser printer according to a second embodiment.

FIG. 11 is a side cross section illustrating a general internal configuration of a laser printer 100 according to the second embodiment. As shown in FIG. 11, the laser printer 100 includes the paper carrying unit 2, the photosensitive drum 3, the charger 4, the scanning unit 5 and a toner supply unit 600.

In the paper supply tray (not shown) provided in the laser printer 100, a stack of sheets of paper P is placed. The paper carrying unit 2 is configured to carry the sheet of paper P along the predetermined paper transport path PP. More specifically, the paper carrying unit 2 includes the pair of registration rollers 21 and the transfer roller 22.

The registration rollers 21 are configured to supply the sheet of paper P to the position between the photosensitive drum 3 and the transfer roller 22 at predetermined timing. The transfer roller 22 is positioned to face the latent image formation surface LS at a transfer position TP while sandwiching the sheet of paper P between the transfer roller 22 and the latent image formation surface LS. The latent image formation surface LS is an outer circumferential surface of the photosensitive drum 3. The transfer roller 22 is rotated in a rotational direction indicated by an arrow in FIG. 11 (i.e., in a counterclockwise direction in FIG. 11).

The transfer roller 22 is connected to a bias power circuit (not shown). From the bias power circuit, a predetermined transfer bias voltage for transferring the toner adhered to the latent image formation surface LS to the sheet of paper P between the photosensitive drum 3 and the transfer roller 22 is applied to the transfer roller 22.

The photosensitive drum 3 serving as an electrostatic latent image holding body has a cylindrical drum shape having a center axis extending in parallel with a main scanning direction (i.e., a z-axis direction in FIG. 11) and is configured to be rotatable in a rotational direction indicated by an arrow shown in FIG. 11 (i.e., a clockwise direction in FIG. 11).

On the outer circumferential surface of the photosensitive drum 3, the latent image formation LS is formed. The latent image formation surface LS is a cylindrical surface provided to be parallel with the center axis (i.e., parallel with the main scanning direction), and is configured such that an electrostatic latent image is formed thereon as a potential distribution. The photosensitive drum 3 is provided such that the latent image formation surface LS moves along the auxiliary scanning direction which is perpendicular to the main scanning direction.

The term auxiliary scanning direction means a direction perpendicular to the main scanning direction. Typically, the auxiliary direction is defined as a direction intersecting with a vertical direction. That is, the auxiliary scanning direction is along a back-and-forth direction of the laser printer 1. In other words, the auxiliary scanning direction is a direction perpendicular to the paper width direction and the height direction (i.e., an x-axis direction in FIG. 11).

The charger 4 is provided to face the latent image formation surface LS. The charger 4 is a corotron type charger or a scorotron charger, and is configured to charge uniformly the latent image formation surface LS.

The scanning unit 5 is configured to emit a laser beam LB modulated based on image data. That is, the scanning unit 5 emits the laser beam LB which is on/off modulated in accordance with presence/absence of pixel data and which has a predetermined wavelength band. Further, the scanning unit 5 is configured to converge the laser beam LB at a scan position SP on the latent image formation surface LS. The scan position SP is located on the downstream side win the rotational direction of the photosensitive drum 3 with respect to the charger 4.

Further, the scanning unit 5 is configured to scan the laser beam LB, at the converged position, on the latent image formation surface in the main scanning direction at a constant speed, so that an electrostatic latent image is formed on the latent image formation surface LS.

The toner supply unit 600 (serving as a developer supply unit) is positioned to face the photosensitive drum 3 at a development position DP.

Figure 12:
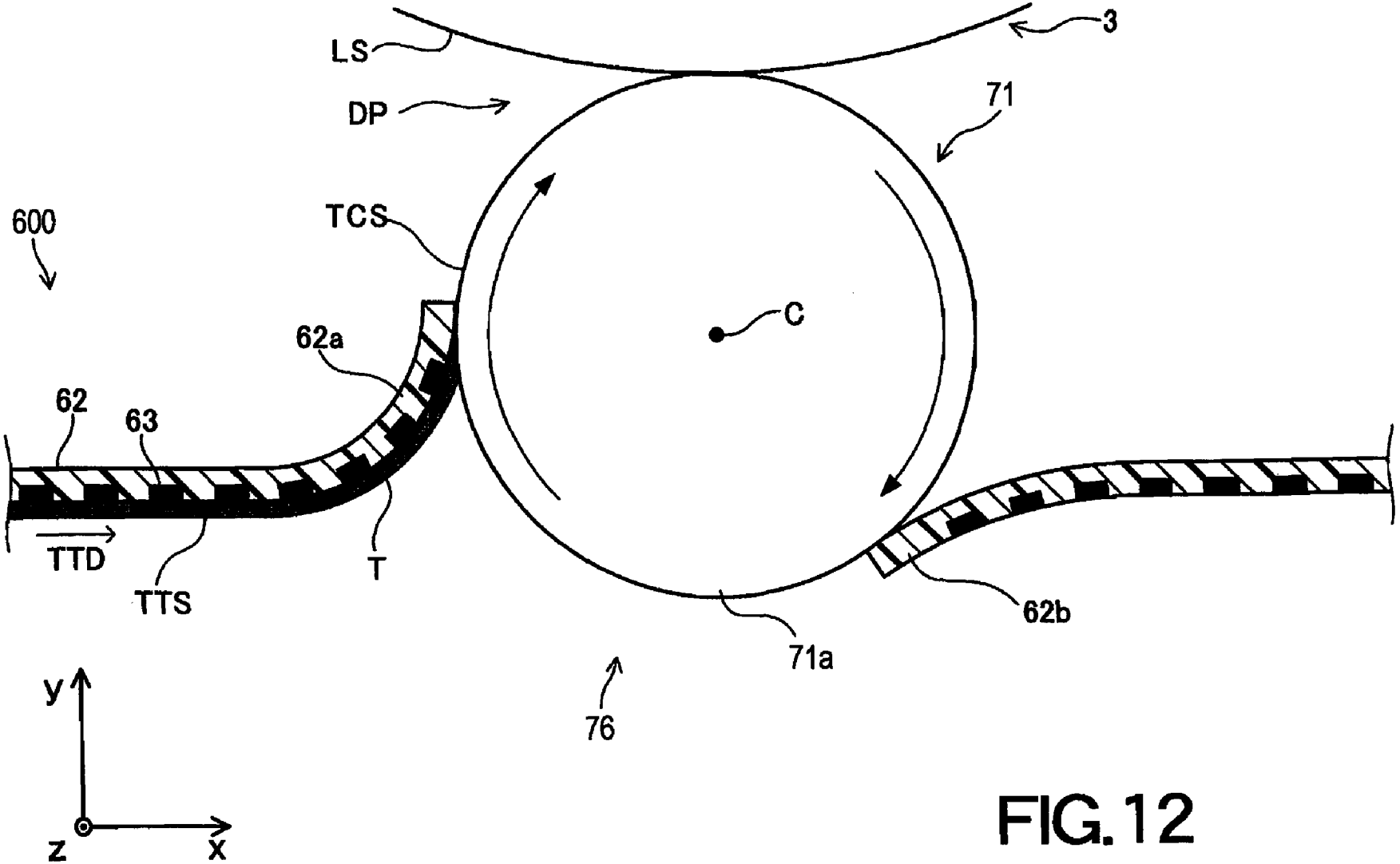
FIG. 12 is an enlarged side cross section illustrating a principal portion of a toner supply unit provided in the laser printer shown in FIG. 11.

FIG. 12 is an enlarged side cross section illustrating a principal portion of the toner supply unit 600. Hereafter, the structure around the development position DP is explained in detail with reference to FIGS. 11 and 12.

The toner supply unit 600 has an opening 76 at a position facing the photosensitive drum 3. The toner supply unit 600 is provided with a cylindrical development roller 71 serving as a developer holding body. The development roller 71 is located to penetrate through the opening 76. As shown in FIG. 12, the toner supply unit 600 accommodates a semicylindrical part 71*a* (i.e., the lower part) of the development roller 71, and lets the upper part of the development roller 71 be exposed to the outside to face the photosensitive drum 3.

The development roller 71 is a roller-like member having a semiconducting property, and has a toner holding surface TCS. The toner holding surface TCS is configured to hold a thin layer of toner T positively charged in a predetermined charge amount. To the development roller 71, a predetermined development bias voltage is applied to set the toner holding surface TCS to have a predetermined development potential. The development roller 71 is rotated in a rotational direction (clockwise direction) indicated by an arrow shown in FIG. 11.

The toner supply unit 600 has the toner carrying substrate 62 serving as a developer carrying substrate. The toner carrying substrate 62 is a thin plate-like member including the upstream edge part 62*a* and the downstream edge part 62*b* constituting a sliding member.

Each of the upstream edge part 62*a* and the downstream edge part 62*b* is configured such that an edge at the opening 76 is formed as a free end. Each of the upstream edge part 62*a* and the downstream edge part 62*b* protrudes toward the opening 76 and is elastically deformable in the vertical direction. That is, the each of the upstream edge part 62*a* and the downstream edge part 62*b* is formed to be a beam fixed only at one end thereof.

The upstream edge part 62*a* is configured to elastically press and slide on the portion of the toner holding surface TCS moving to the outside from the opening 76, on the upstream side in the toner transport direction TTD with respect to the opening 76. Further, the upstream edge part 62*a* is positioned such that the toner transport surface TTS which is an inner surface facing the inside of the toner supply unit 600 slides on the toner holding surface TCS. The upstream edge part 62*a* is configured to slide on the toner holding surface TCS along the entire length thereof in the main scanning direction.

The downstream edge part 62*b* is configured to elastically press and slide on the portion of the toner holding surface TCS moving to enter the inside from the opening 76, on the downstream side in the toner transport direction TTD with respect to the opening 76. Further, the downstream edge part 62*b* is positioned such that an outer surface thereof facing the outside slides on the toner holding surface TCS. The downstream edge part 62*b* is configured to slide on the toner holding surface TCS along the entire length thereof in the main scanning direction.

The toner carrying substrate 62 is provided with a plurality of carrying electrodes 63 on an insulative support layer. The plurality of carrying electrodes 63 are arranged along in the auxiliary scanning direction which is parallel with the toner transport direction TTD so that the charged toner T is carried in the toner transport direction TTD through a traveling electric field.

As described above, the toner supply unit 600 is configured to supply the toner T to the latent image formation surface LS via the development roller 71 while carrying the toner T on the toner carrying substrate 62 in the toner transport direction TTD.

Hereafter, operations of the laser printer 100 are explained.

The leading edge of the sheet of paper P stacked on the paper supply tray (not shown) is carried to the registration roller 21 along the paper transport path PP. The registration roller corrects skew of the sheet of paper and adjusts the carrying timing. Then, the sheet of paper P is carried to the transfer position TP along the paper transport path PP.

While the sheet of paper P is carried toward the transfer position TP, a toner image is formed on the latent image formation surface LS as follows.

First, the latent image formation surface LS of the photosensitive drum 3 is charged uniformly by the charger 4. The latent image formation surface LS charged by the charger 4 moves to the scan position SP by rotation in the direction indicated by the arrow shown in FIG. 11. That is, the latent image formation surface LS moves, in the auxiliary scanning direction, to the scan position facing the scanning unit 5.

At the scan position SP, the laser beam LB on/off modulated in accordance with the image data scans on the latent image formation surface LS in the main scanning direction. In accordance with the modulation of the laser beam LB, parts of the positive charges on the latent image formation surface LS disappear. As a result, a pattern of positive charges is formed on the latent image formation surface LS as an electrostatic latent image.

The electrostatic latent image formed on the latent image formation surface LS moves to the development position DP facing the toner supply unit 6 by rotation of the photosensitive drum 3 in the direction indicated by the arrow shown in FIG. 11 (i.e., in the clockwise direction).

The voltage having a traveling waveform is applied to the plurality of electrodes 63 on the toner carrying substrate 62. As a result, the traveling electric field is produced on the toner transport surface TTS. Through the traveling electric field, the positively charged toner T is carried on the toner transport surface TTS in the toner transport direction TTD.

The toner T being carried on the toner transport surface TTS through the traveling electric field reaches the position where the inner surface of the upstream edge part 62*a* of the toner carrying substrate 62 slides on the toner holding surface TCS of the development roller 61. At this position, the toner T is held on the toner holding surface TCS in a form of a thin layer.

The positively charged tone T thus held on the toner holding surface TCS is supplied to the development position DP by rotation of the development roller 71 in the direction (clockwise direction) indicated by an arrow shown in FIG. 12.

At the development position DP, the toner holding surface TCS and the latent image formation surface LS face with each other while sandwiching the thin toner layer therebetween. At this time, the toner T is adhered to parts on the latent image formation surface LS where the positive charges disappear. That is, the electrostatic latent image is developed by the toner T. As a result, the toner image is held on the latent image formation surface LS.

The toner image thus formed on the latent image formation surface LS of the photosensitive drum 3 is then carried to the transfer position TP by rotation of the latent image formation surface in the direction (clockwise direction) indicated by an arrow shown in FIG. 11. At the transfer position TP, the toner image is transferred to the sheet of paper P.

In the above described embodiment, the toner transport surface TTS of the upstream edge part 62*a* face-contacts the portion of the toner holding surface TCS moving to the outside from the opening 76 while sandwiching the thin toner layer between the toner transport surface TTS and the toner holding surface TCS. At this time, a certain amount of toner T is pooled between the toner transport surface TTS of the upstream edge part 62*a* and the toner holding surface TCS. In this condition, the toner T moves from the toner transport surface TTS to the toner holding surface TCS. Therefore, a thin layer of toner T is formed on the toner holding surface TCS.

Therefore, according to the second embodiment, the thin toner layer of toner T can be uniformly formed on the toner holding surface TCS. Consequently, it is possible to effectively prevent occurrence of density fluctuations of the image in the auxiliary scanning direction.

In the above described second embodiment, the semicylindrical part 71*a* of the development roller 61 is accommodated in the toner supply unit 600 through the opening 76. The upstream edge part 62*a* which is an upstream side edge of the opening 76 in the toner transport direction TTD and the downstream edge part 62*b* which is an downstream side edge of the opening 76 in the toner transport direction TTD slide on the toner holding surface TCS.

According to such a configuration, the toner T can be prevented from leaking to the outside of the toner supply device 600 through the opening 76. Therefore, the inside of the laser printer 100 and the sheet of paper can be effectively prevented from being tainted due to leaking of the toner T.

Hereafter, variations of structures of the toner supply unit 600 are explained. In the following, only features of the variations are explained for the sake of simplicity. In the following drawings, to elements, which are substantially the same as those of the second embodiment, the same reference numbers are assigned.

(First Variation of Second Embodiment)

Figure 13:
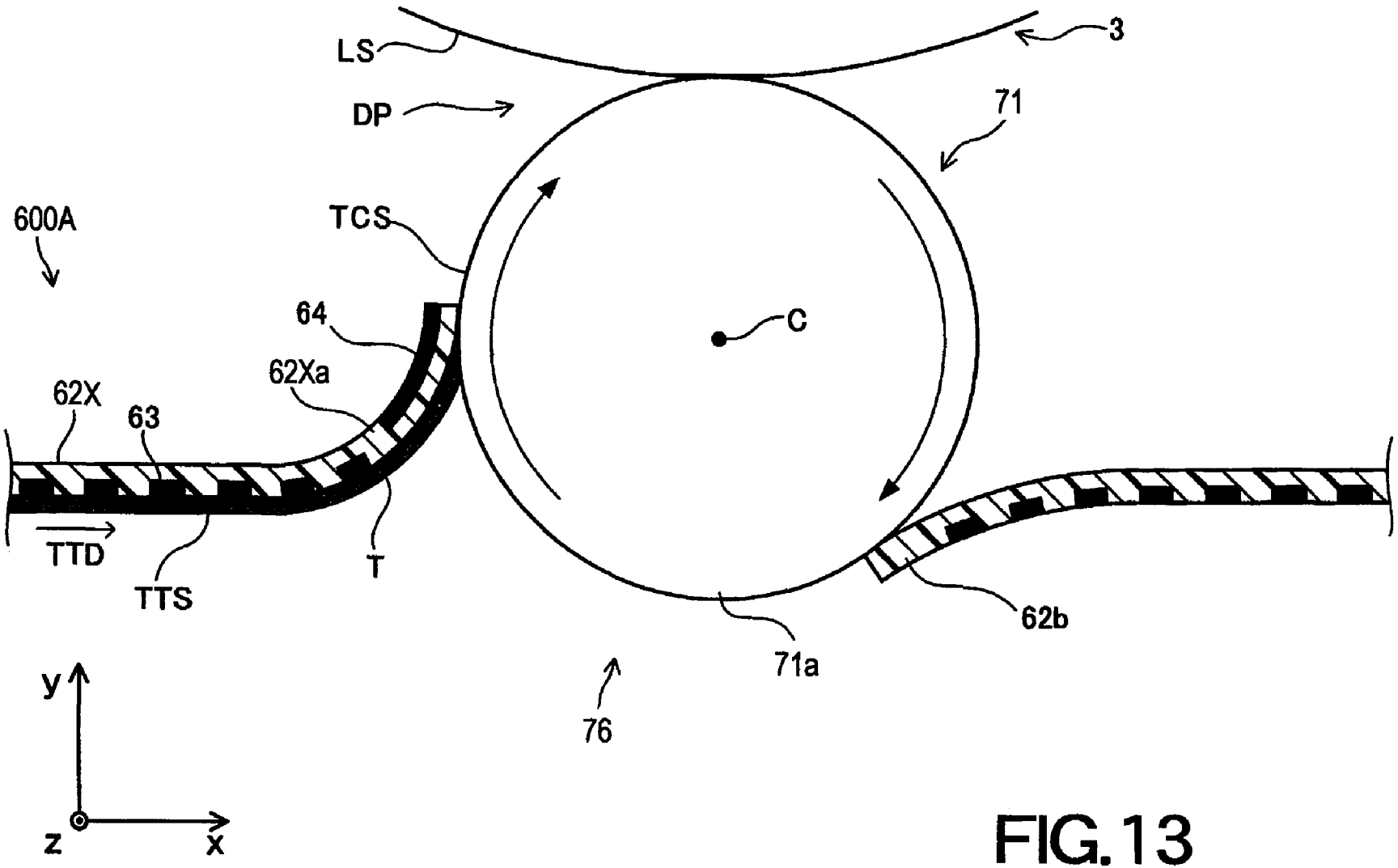
FIG. 13 is an enlarged cross section illustrating a structure of a toner supply unit according to a first variation of the second embodiment.

FIG. 13 is an enlarged cross section illustrating the structure of a toner supply unit 600A of a first variation. As shown in FIG. 13, the toner supply unit 600A is provided with the toner carrying substrate 62X having the upstream edge part 62Xa. A tip end of the upstream edge part 62Xa is not provided with the carrying electrode 63. Instead, the tip end of the upstream edge part 62Xa is provided with the dummy electrode 64. The dummy electrode 64 is configured to be wider than the electrode 63 in the auxiliary scanning direction. In contrast to the carrying electrode 63, the dummy electrode 64 is supplied with a predetermined bias voltage. The predetermined bias voltage supplied to the dummy electrode 64 is set such that the positively charged toner T is smoothly transferred from the toner transport surface TTS to the toner holding surface TCS.

With this configuration, the part of the toner transport surface TTS sliding on the toner holding surface TCS is prevented from being charged up. Therefore, occurrence of disarrangement of an image due to adhesion of the toner T to such a part of the toner transport surface TTS can be prevented.

(Second Variation of Second Embodiment)

Figure 14:
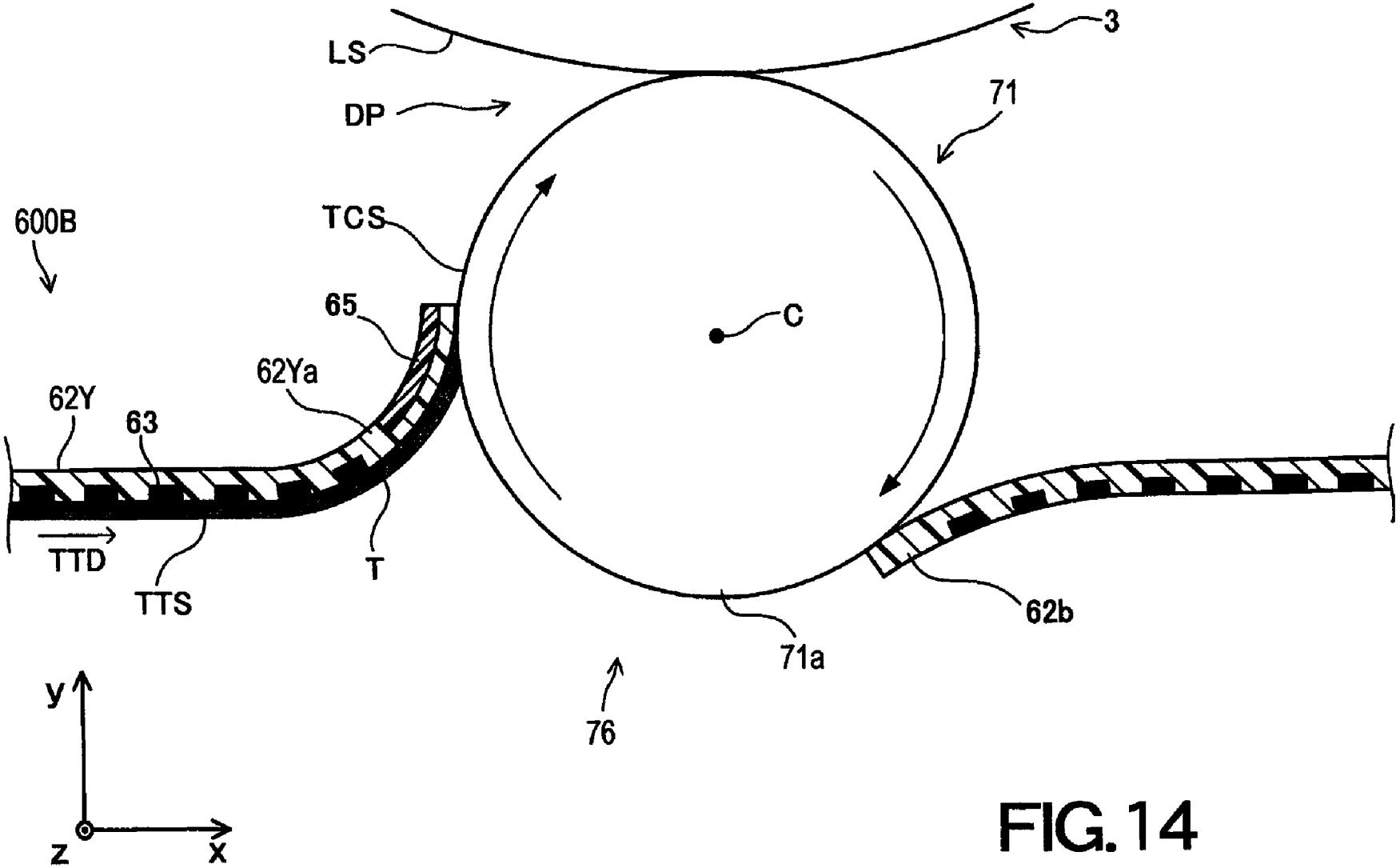
FIG. 14 is an enlarged cross section illustrating a structure of a toner supply unit according to a second variation of the second embodiment.

FIG. 14 is an enlarged cross section illustrating the structure of a toner supply unit 600B of a second variation. As shown in FIG. 14, the toner supply unit 600B is provided with the toner carrying substrate 62Y having the upstream edge part 62Ya. A tip end of the upstream edge part 62Ya is not provided with the carrying electrode 63. Instead, the tip end of the upstream edge part 62Ya is provided with the conductor part 65. The conductor part 65 is integrally formed of material having conductivity (e.g., material having conductivity of volume resistivity ranging from $10^7$ to $10^{10}$ Ω·cm). As in the case of the dummy electrode 64 of the first variation, the conductor part 65 is supplied with a predetermined bias voltage.

With this configuration, the same advantages as those of the first variation can be achieved.

(Other Variations)

In the above described second embodiment, the technical features are implemented on a monochrome laser printer. However, the technical features described in the second embodiment can be implemented on various types of electrophotographic image formation devices, such as a color laser printer, or a monochrome or color facsimile device.

In the above described embodiment, the photosensitive drum has a drum-like shape. However, the photosensitive drum may have a different shape. For example, a photosensitive belt having a form of an endless belt may be employed in place of the photosensitive drum 3.

In the above described embodiment, the semicylindrical part 71*a* has a form of a complete semicylinder shape. However, it should be understood that the semicylindrical part 71*a* does not need to have a complete semicylinder shape. The semicylindrical part 71*a* may have a center angle smaller than 180 degrees, or may have a center angle larger than 180 degrees.

A part of the semicylindrical part 71*a* may be accommodated in the toner supply unit 600. Alternatively, a part of the development roller 71 including the semicylindrical part 71*a* and anther part of the development roller 71 may be accommodated in the toner supply unit 600.

In the above described embodiment, the upstream edge part 62*a* face-contacts the development roller 71. However, contact between the upstream edge par 62*a* and the development roller 71 is not limited to such face-contact. For example, the upstream edge part 62*a* may be provided such that an edge of the upstream edge part 62*a* contacts the development roller 71.

Figure 15:
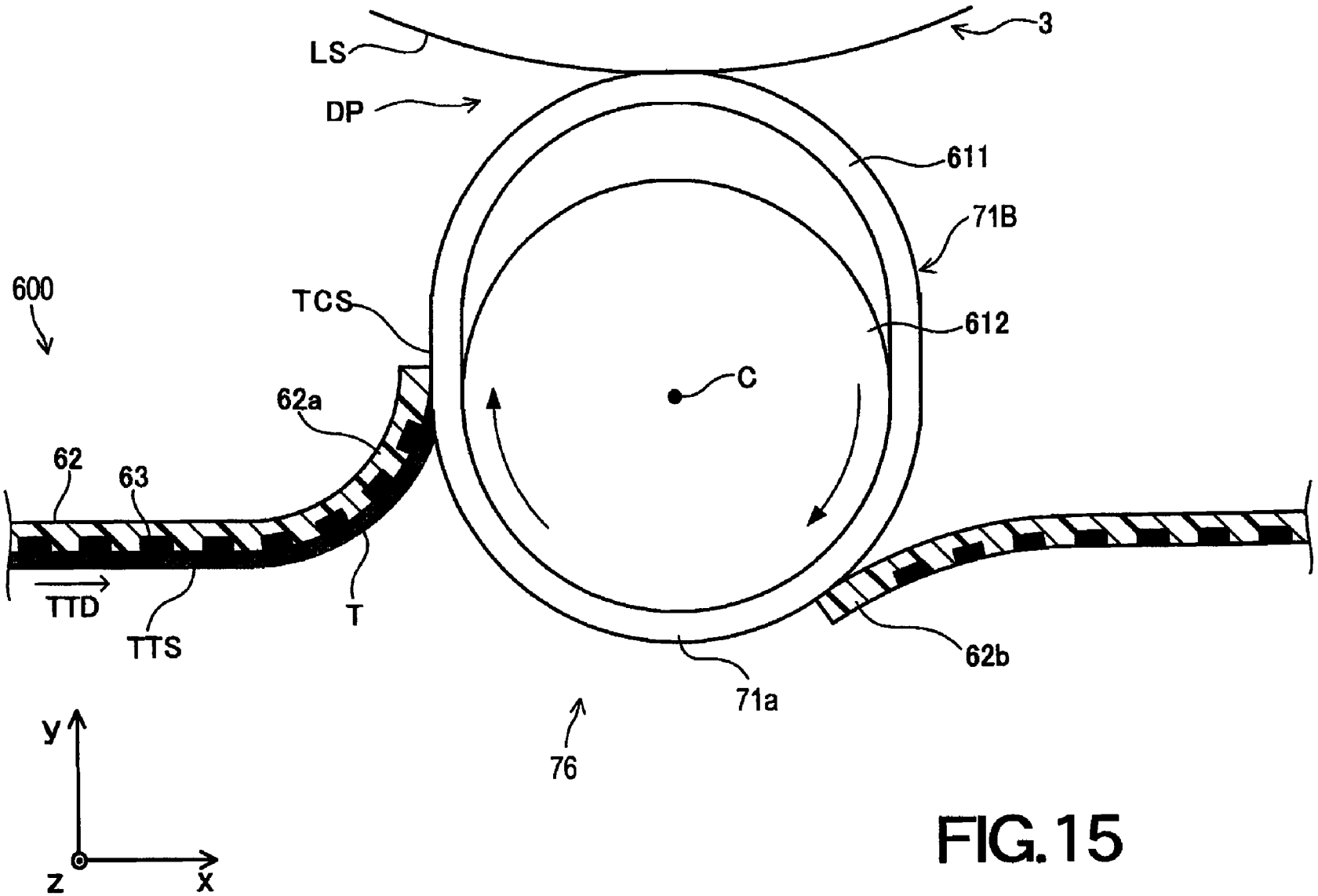
FIG. 15 illustrates a variation of a development roller of the second embodiment.

FIG. 15 is a side cross section illustrating a variation of the development roller 71. In FIG. 15, a development roller 71B includes a development sleeve 611 having a cylindrical shape and a sleeve support roller 612. The development sleeve 611 is formed of a thin plate-like conductive member (e.g., a metal plate, a carbon sheet or a conductive synthetic resin film). The sleeve support roller 612 is formed of an elastic roller (e.g., a sponge roller) accommodated in the development sleeve 611.

As shown in FIG. 15, in the development sleeve 611, a certain gap may be formed between the development sleeve 611 and the sleeve support roller 612 in a region facing the photosensitive drum 3 so as to allow the part of the development sleeve 611 facing the photosensitive drum 3 to be elastically deformable by a pressing force from the photosensitive drum 3.

With this configuration, the latent image formation surface LS and the toner holding surface TCS which is the surface of the development sleeve 611 holding the toner T press and slide with respect to each other while sandwiching the thin toner layer therebetween. Therefore, the electrostatic latent image on the latent image formation surface LS is developed while being pressed elastically by the toner transport surface TTS via the thin layer of toner T.

Therefore, according to such a configuration, it is possible to prevent occurrence of "thinning" of an edge part of an image The structure of the part of the downstream edge part 62*b* sliding on the toner holding surface TCS moving to enter the inside of the toner supply unit through the opening 76 is not limited to that shown in the above described embodiment.

For example, the downstream edge part 62*b* may be configured not to have the carrying electrodes 63. Alternatively, the laser printer may be provided with a sliding member separately from the toner carrying substrate 62. In this case, the sliding member is positioned to slide on the part of the photosensitive surface LS moving to enter the inside of the toner supply unit through the opening 61, in place of the downstream edge part 62*b*.

Figure 16:
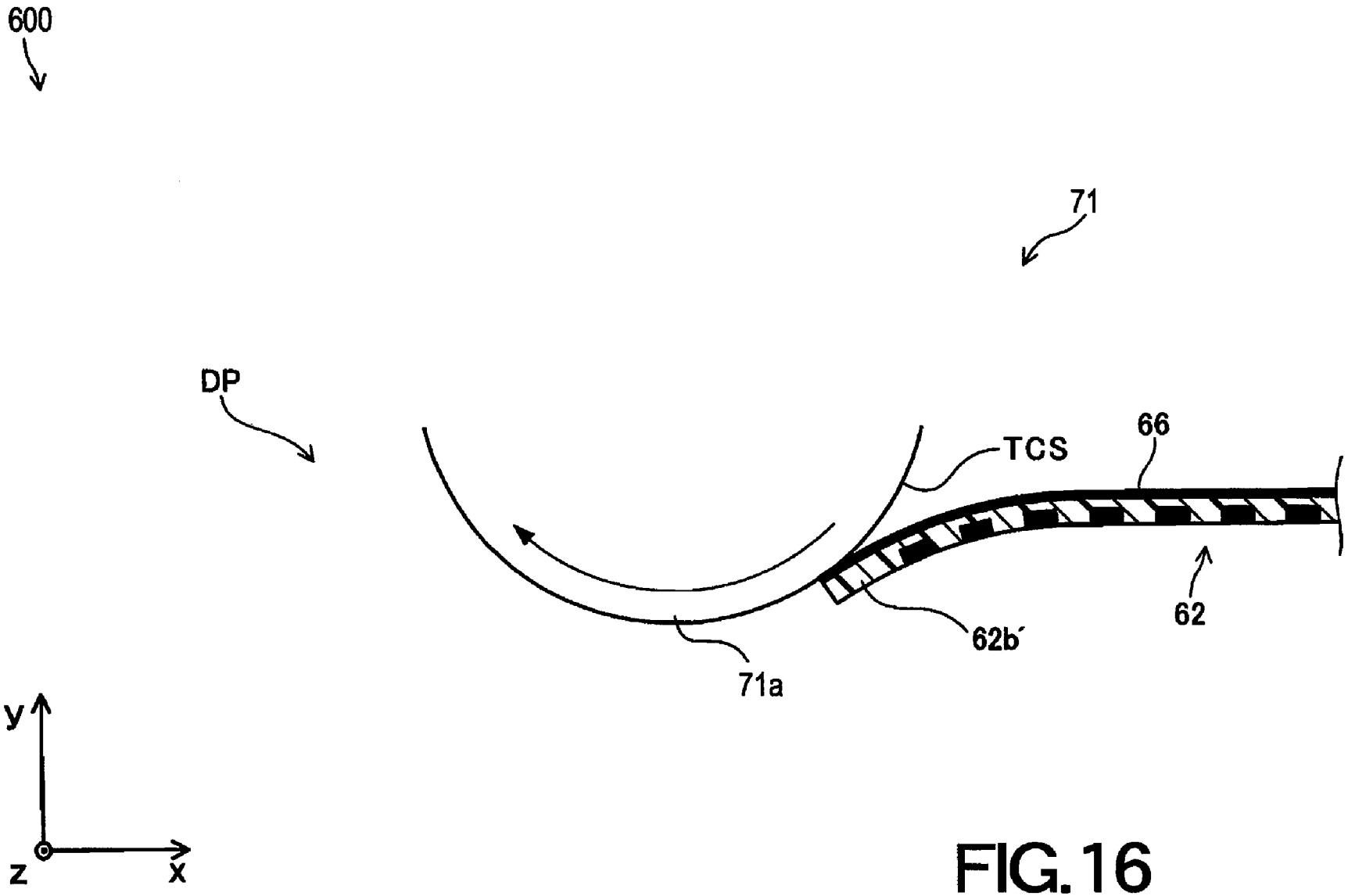
FIG. 16 illustrates a variation of a downstream edge part of a toner carrying substrate of the second embodiment.

FIG. 16 illustrates a variation (a downstream edge part 62*b*') of the downstream edge part 62*b*. As shown in FIG. 16, the downstream edge part 62*b*' is configured such that the conductive layer 66 for preventing charging up may be formed on the surface of the toner carrying substrate 62 facing the toner holding surface TCS of the development roller 61.

The conductive layer 66 is formed of a coating layer having a conductivity (e.g., surface resistance of approximately $10^7$ to $10^{10}$ Ω/sq). The conductive layer 66 is supplied with the above described bias voltage.

It is understood that the toner carrying substrate 62 used in the second embodiment may also be provided with the insulative protective layer 67 is shown in FIGS. 8-10.

What is claimed is:

1. An image formation device, comprising:

a holding body configured to hold thereon developer and to have a center axis extending in a main scanning direction; and a developer supply unit configured to supply the developer to the holding body through a traveling electric field, the developer supply unit having an opening through which a part of a surface of the holding body is placed inside the developer supply unit, the developer supply unit comprising a sliding member configured to slide on at least a part of the surface of the holding body moving toward an outside of the developer supply unit through the opening.

2. The image formation device according to claim 1, wherein:

the holding body comprises an electrostatic latent image holding body having an semicylindrical part having the center axis extending in parallel with the main scanning direction, the electrostatic latent image holding body having a latent image formation surface on which an electrostatic latent image is formed as potential distribution;

the electrostatic latent image holding body is configured such that the latent image formation surface moves in a direction perpendicular to the main scanning direction;

the developer supply unit has a plurality of carrying electrodes arranged along a direction intersecting with the main scanning direction, and is configured to move the developer in the direction intersecting with the main scanning direction through the traveling electric field to supply the developer to the latent image formation surface of the electrostatic latent image holding body;

the developer supply unit is configured to accommodate therein the semicylindrical part of the electrostatic latent image holding body through the opening; and the sliding member is configured to slide on a part of the latent image formation surface moving toward the outside of the developer supply unit.

3. The image formation device according to claim 1, further comprising an electrostatic latent image holding body having a latent image formation surface on which an electrostatic latent image is formed as potential distribution, wherein:

the holding body comprises a developer holding body having a cylindrical shape and having a cylindrical developer holding surface on which the developer is held;

the developer supply unit comprises the developer holding body;

the developer supply unit has a plurality of carrying electrodes arranged along a direction intersecting with the main scanning direction, and is configured to move the developer in the direction intersecting with the main scanning direction through the traveling electric field to supply the developer to the cylindrical developer holding surface so that the developer is supplied to the latent image formation surface of the electrostatic latent image holding body;

the developer supply unit is configured to accommodate therein a part of the developer holding body and to expose the other part of the developer holding body to the outside of the developer supply unit; and the sliding member is configured to slide on a part of the cylindrical developer holding surface moving toward the outside of the developer supply unit.

4. The image formation device according to claim 1, wherein the sliding member is further configured to slide on a part of the holding body moving toward an inside of the developer supply unit through the opening.

5. The image formation device according to claim 1, wherein the sliding member is configured to slide on the part of the surface of the holding body along an entire length of the sliding member in the main scanning direction.

6. The image formation device according to claim 1, wherein:

the developer supply unit has a developer carrying substrate having a form of a thin plate, the plurality of carrying electrodes being formed on the developer carrying substrate; and the sliding member includes an edge part of the developer carrying substrate.

7. An image formation device, comprising:

a holding body configured to hold thereon developer and to have a center axis extending in a main scanning direction; and a developer supply unit configured to supply the developer to the holding body through a traveling electric field, the developer supply unit having an opening through which a part of the holding body is accommodated in the developer supply unit, the developer supply unit including a sliding member configured to slide on at least a part of a surface of the holding body moving toward an outside of the developer supply unit through the opening, wherein the developer supply unit has a developer carrying substrate having a form of a thin plate, the plurality of carrying electrodes being formed on the developer carrying substrate, wherein the sliding member includes an edge part of the developer carrying substrate, and wherein the sliding member includes a part of the developer carrying substrate where no carrying electrode is formed.

8. The image formation device according to claim 7, wherein a dummy electrode is formed at the edge part of the developer carrying substrate.

9. The image formation device according to claim 8, wherein the dummy electrode has a width larger than a width of each of the plurality of electrodes.

10. The image formation device according to claim 6, wherein the sliding member is configured such that an inner surface thereof facing an inside of the developer supply unit slides on the part of the surface of the holding body.

11. The image formation device according to claim 1, wherein the sliding member includes a conductive part to which a predetermined bias voltage is applied.

12. A developer supply device, comprising:

a plurality of electrodes arranged in a direction intersecting with a main scanning direction to supply developer through a traveling electric field;

an opening through which a part of a surface of a holding body to hold the developer is placed inside the developer supply unit, and a sliding member configured to slide on at least a part of the surface of the holding body moving toward an outside of the developer supply device through the opening.

13. The developer supply device according to claim 12, wherein:

the holding body comprises an electrostatic latent image holding body having an semicylindrical part having a center axis extending in parallel with the main scanning direction, the electrostatic latent image holding body having a latent image formation surface on which an electrostatic latent image is formed as potential distribution;

the electrostatic latent image holding body is configured such that the latent image formation surface moves in a direction perpendicular to the main scanning direction;

the plurality of carrying electrodes are arranged to move the developer in the direction intersecting with the main scanning direction through the traveling electric field to supply the developer to the latent image formation surface of the electrostatic latent image holding body;

the semicylindrical part of the electrostatic latent image holding body is accommodated in the developer supply device through the opening; and the sliding member is configured to slide on a part of the latent image formation surface moving toward the outside of the developer supply device.

14. The developer supply device according to claim 12, further comprising, as the holding body, a developer holding body having a cylindrical shape and having a cylindrical developer holding surface on which the developer is held;

the plurality of carrying electrodes are arranged to move the developer in the direction intersecting with the main scanning direction through the traveling electric field to supply the developer to the cylindrical developer holding surface of the developer holding body;

a part of the developer holding body is accommodated in the developer supply device and the other part of the developer holding body is exposed to the outside of the developer supply device so that the other part of the developer holding body faces an electrostatic latent image holding body provided outside of the developer supply device; and the sliding member is configured to slide on a part of the cylindrical developer holding surface moving toward the outside of the developer supply device.

15. The developer supply device according to claim 12, wherein the sliding member is further configured to slide on a part of the holding body moving toward an inside of the developer supply unit through the opening.

16. The developer supply device according to claim 12, wherein the sliding member is configured to slide on the part of the surface of the holding body along an entire length of the sliding member in the main scanning direction.

17. The developer supply device according to claim 12, wherein:

the developer supply unit has a developer carrying substrate having a form of a thin plate, the plurality of carrying electrodes being formed on the developer carrying substrate; and the sliding member includes an edge part of the developer carrying substrate.

18. A developer supply device, comprising:

a plurality of electrodes arranged in a direction intersecting with a main scanning direction to supply developer through a traveling electric field;

an opening through which a part of a holding body to hold the developer is accommodated in the developer supply unit, and a sliding member configured to slide on at least a part of a surface of the holding body moving toward an outside of the developer supply device through the opening, wherein the developer supply unit has a developer carrying substrate having a form of a thin plate, the plurality of carrying electrodes being formed on the developer carrying substrate, wherein the sliding member includes an edge part of the developer carrying substrate, and wherein the sliding member includes a part of the developer carrying substrate where no carrying electrode is formed.

19. The developer supply device according to claim 18, wherein a dummy electrode is formed at the edge part of the developer carrying substrate.

20. The developer supply device according to claim 19, wherein the dummy electrode has a width larger than a width of each of the plurality of electrodes.

21. The developer supply device according to claim 17, wherein the sliding member is configured such that an inner surface facing an inside of the developer supply unit slides on the part of the surface of the holding body.

22. The developer supply device according to claim 12, wherein the sliding member includes a conductive part to which a predetermined bias voltage is applied.

* * * * *